US012324489B2

(12) United States Patent
Lokker

(10) Patent No.: US 12,324,489 B2
(45) Date of Patent: Jun. 10, 2025

(54) EXTENDABLE JEWELRY CLASP

(71) Applicant: Easy Wear Jewelry LLC, Hartford, WI (US)

(72) Inventor: Kayla Lokker, Hartford, WI (US)

(73) Assignee: EASY WEAR JEWELRY LLC, Hartford, WI (US)

( * ) Notice: Subject to any disclaimer, the term of this patent is extended or adjusted under 35 U.S.C. 154(b) by 0 days.

(21) Appl. No.: 18/930,341

(22) Filed: Oct. 29, 2024

(65) Prior Publication Data

US 2025/0134220 A1 May 1, 2025

Related U.S. Application Data

(60) Provisional application No. 63/594,239, filed on Oct. 30, 2023.

(51) Int. Cl.
*A44C 15/00* (2006.01)
*A44C 25/00* (2006.01)

(52) U.S. Cl.
CPC ..... *A44C 15/005* (2013.01)

(58) Field of Classification Search
CPC ... A44C 15/005; A44C 15/0069; A44C 25/00; A44C 5/22; A44C 5/18; A44C 5/185; A44C 5/0069
USPC ..... 242/371, 375, 376, 377, 379; 24/114.5, 24/3.13; 63/5.1, 3.2
See application file for complete search history.

(56) References Cited

U.S. PATENT DOCUMENTS 1,831,666 A * 11/1931 Jacobia ..... A45F 5/004 242/385.4
2009/0120130 A1 5/2009 Mabra
2017/0354211 A1 12/2017 Matz et al.
2020/0329831 A1 10/2020 Kubiak
2022/0007822 A1 1/2022 Al-Jabry et al.

FOREIGN PATENT DOCUMENTS

JP 2013118891 A * 6/2013
JP 2014204833 A * 10/2014 ..... A44C 15/005
WO WO-2011/155927 A1 12/2011

OTHER PUBLICATIONS

International Search Report and Written Opinion on PCT Appl. No. PCT/US2024/053389 dated Feb. 25, 2025 (13 pages).

* cited by examiner

*Primary Examiner* — Jack W Lavinder
(74) *Attorney, Agent, or Firm* — FOLEY & LARDNER LLP

(57) ABSTRACT

A jewelry system comprising a necklace and a clasp. The clasp includes a housing having a bottom including a hole disposed in a side of the bottom and a centered anchor post comprising a groove disposed perpendicular to the hole. The clasp also includes an actuator comprising an actuator housing having a housing anchor, an opening, and a connector interface, and a spring comprising a first spring anchor and a second spring anchor, wherein the spring is received in the actuator housing by coupling the second spring anchor with the housing anchor. The actuator housing is received in the bottom such that the anchor post is inserted into the opening and the groove receives the first spring anchor of the spring. The clasp includes a cord having a first end coupled with the connector interface and a second end to be pulled away from the clasp.

20 Claims, 21 Drawing Sheets

EXTENDABLE JEWELRY CLASP

CROSS-REFERENCE TO RELATED PATENT APPLICATION

This application claims the benefit of and priority to U.S. Provisional Application No. 63/594,239, filed Oct. 30, 2023, which is hereby incorporated by reference herein in its entirely and for all purposes.

BACKGROUND

The present disclosure relates generally to an item of jewelry. More specifically, the present disclosure relates to an extendable clasp for an item of jewelry.

SUMMARY

At least one embodiment relates to a jewelry system. The jewelry system comprises a necklace and a clasp. The necklace has a first end and a second end. The clasp comprises a housing, an actuator, and a cord. The housing has a housing top and a housing bottom. The housing bottom comprises a hole disposed in a side of the housing bottom and an anchor post comprising a groove disposed perpendicular to the hole. The anchor post is centered within the housing bottom. The actuator comprises an actuator housing and a spring. The actuator housing comprises a housing anchor, an opening, and a connector interface. The spring comprises a first spring anchor and a second spring anchor. The spring is received in the actuator housing by coupling the second spring anchor with the housing anchor. The actuator housing is received in the housing bottom such that the anchor post is inserted into the opening of the actuator housing and the groove of the anchor post receives the first spring anchor of the spring, such that the spring is configured to rotate the actuator housing respective of the housing bottom when the spring biases between an expanded configuration and a compressed configuration. The cord has a first end coupled with the connector interface of the actuator housing and a second end configured to be pulled away from the clasp. The housing top is configured to couple with the housing bottom to retain the actuator housing therein. When a force is applied to the necklace, the cord is configured to be pulled away from the clasp to cause the actuator housing to rotate relative to the housing bottom. When the force is applied to the necklace, the clasp is also configured to transition from a retracted configuration to a non-retracted configuration. The necklace and the clasp have a first circumference when in the retracted configuration, and the necklace and the clasp have a second circumference when in the non-retracted configuration that is greater than the first circumference.

In some embodiments, the housing anchor is a projection, and the second spring anchor is wrapped around the housing anchor to couple the spring and the actuator housing. In some embodiments, the housing anchor is a flange including an aperture, and the second spring anchor is received through the aperture to engage the flange to couple the spring and the actuator housing. In some embodiments, the connector interface extends about an exterior of the actuator housing. In some embodiments, the connector interface is configured to engage the cord to wind the cord about the actuator housing when the clasp is in the retracted configuration. In some embodiments, the connector interface comprises a projection extending from a bottom surface of the actuator housing. In some embodiments, the connector interface is configured to engage the cord to wind the cord about the projection. In some embodiments, in the expanded configuration, the spring is configured to apply a biasing force to the actuator housing to hold the actuator housing stationary relative to the housing bottom. In some embodiments, when the force is applied to the necklace, the spring is configured to bias to the compressed configuration. In some embodiments, in the compressed configuration, the spring is configured to limit a rotational movement of the actuator housing relative to the housing bottom.

Another embodiment relates to a clasp. The clasp comprises a housing, an actuator, and a cord. The housing has a housing top and a housing bottom. The housing bottom comprises a hole disposed in a side of the housing bottom and an anchor post comprising a groove disposed perpendicular to the hole. The anchor post is centered within the housing bottom. The actuator comprises an actuator housing and a spring. The actuator housing comprises a housing anchor, an opening, and a connector interface. The spring comprises a first spring anchor and a second spring anchor. The spring is received in the actuator housing by coupling the second spring anchor with the housing anchor. The actuator housing is received in the housing bottom such that the anchor post is inserted into the opening of the actuator housing and the groove of the anchor post receives the first spring anchor of the spring, such that the spring is configured to rotate the actuator housing respective of the housing bottom when the spring biases between an expanded configuration and a compressed configuration. The cord has a first end coupled with the connector interface of the actuator housing and a second end configured to be pulled away from the clasp. The housing top is configured to couple with the housing bottom to retain the actuator housing therein. When a force is applied to the cord, the cord is configured to be pulled away from the clasp to cause the actuator housing to rotate relative to the housing bottom. When the force is applied to the cord, the clasp is configured to transition from a retracted configuration to a non-retracted configuration. The cord and the clasp have a first length when in the retracted configuration, and the cord and the clasp have a second length when in the non-retracted configuration that is greater than the first length.

In some embodiments, the housing anchor is a projection, and the second spring anchor is wrapped around the housing anchor to couple the spring and the actuator housing. In some embodiments, the housing anchor is a flange including an aperture, and the second spring anchor is received through the aperture to engage the flange to couple the spring and the actuator housing. In some embodiments, the connector interface extends about an exterior of the actuator housing. In some embodiments, the connector interface is configured to engage the cord to wind the cord about the actuator housing. In some embodiments, the connector interface comprises a projection extending from a bottom surface of the actuator housing. In some embodiments, the connector interface is configured to engage the cord to wind the cord about the projection. In some embodiments, in the expanded configuration, the spring is configured to apply a biasing force to the actuator housing to hold the actuator housing stationary relative to the housing bottom. In some embodiments, when the force is applied to the cord, the spring is configured to bias to the compressed configuration. In some embodiments, in the compressed configuration, the spring is configured to limit a rotational movement of the actuator housing relative to the housing bottom.

Another embodiment relates to a jewelry kit. The jewelry kit comprises a necklace and a clasp. The a necklace has a first end and a second end. The clasp is configured to couple with the first end and the second end. The clasp comprises a housing, an actuator, and a cord. The actuator comprises a spring configured to rotate an actuator housing respective of the housing when the spring biases between an expanded configuration when the cord is in a retracted configuration and the necklace has a first circumference and between a compressed configuration when the cord is in a non-retracted configuration and the necklace has a second circumference that is greater than the first circumference.

In some embodiments, the jewelry kit further comprises a pendant configured to couple with the necklace.

This summary is illustrative only and is not intended to be in any way limiting. Other aspects, inventive features, and advantages of the systems and processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, a jewelry system having a necklace and an expandable clasp configured to ease application or removal of the necklaces is shown, according to an exemplary embodiment. The system is shown to include a clasp that is configured to couple opposing ends of a necklace, and expand and retract to allow a user to easily fit the necklace onto their body (e.g., over their head, around their neck, etc.). The clasp may also include magnets that secure the clasp in its retracted state, for example to ensure proper fit or more securely fasten the necklace to the user. In this regard, the expandable clasp described herein may be suitable for selectively coupling any existing article of jewelry (e.g., necklace, bracelet, watch, etc.) to ease the process of putting on and taking off the article of jewelry and to enable putting on and taking off the article of jewelry with one hand.

Advantageously, the exemplary features of the jewelry system described herein may ease the process of putting on and taking off an article of jewelry (e.g., a necklace, bracelet, watch, etc.). In this sense, the jewelry system may advantageously facilitate application or removal of components of the jewelry system by individuals with one or more ailments of afflictions. For example, the jewelry system may include components (e.g., a large, easy-to-grip clasp, ergonomic shaped grips, etc.) that facilitate use by individuals with limited or reduced fine motor skills (e.g., those with arthritis, etc.). Similarly, the jewelry system may advantageously facilitate application or removal of components of the jewelry system using one hand. For example, the jewelry system may include components (e.g., a spring-loaded mechanism, a push-button, a slide mechanism, etc. in the clasp, for example to facilitate opening or closing the clasp etc.) that facilitate use by an individual with one hand (e.g., an individual with limited limb mobility, an amputee, etc.).

Figure 1:
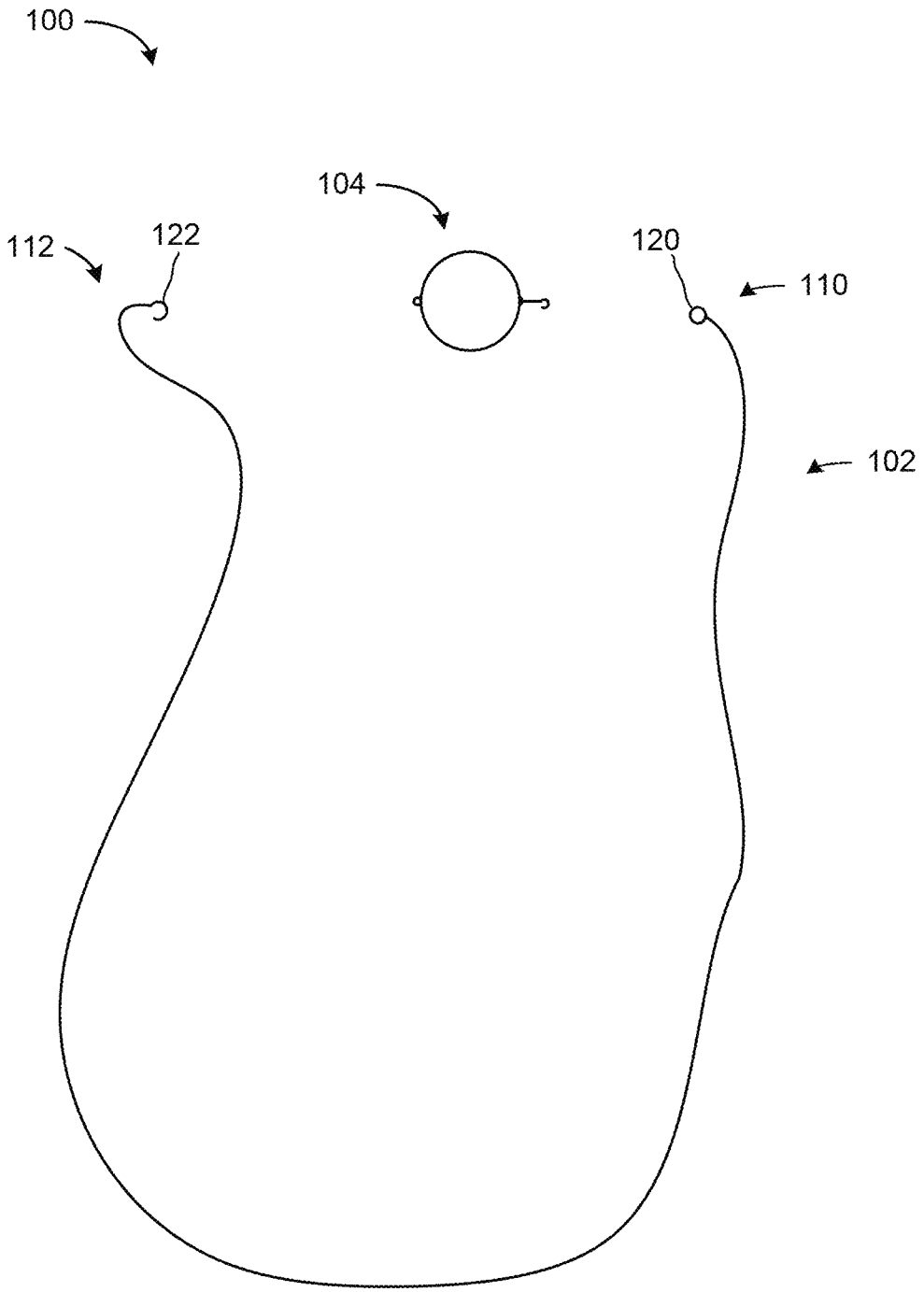
FIG. 1 is an illustration of a jewelry system comprising a necklace and a clasp, according to an exemplary embodiment.

Referring now to FIG. 1, a jewelry system 100 is shown according to an exemplary embodiment. The jewelry system 100 is shown to include an article or item of jewelry, shown as a necklace 102, and an adjustable coupling mechanism, shown as a clasp 104. The necklace 102 may engage an anatomical feature of a user, or display one or more decorative items. For example, the necklace 102 may be a removable necklace that engages a neck, shoulder, or chest region of a user to display a charm or decorative item. The necklace 102 may also couple the clasp 104, and the clasp 104 may be configured to expand and retract, for example to allow a user to fit the necklace 102 onto their body (e.g., around their neck, shoulder, or chest region). While the article or item of jewelry is described herein as being the necklace 102, it is contemplated that in other embodiments the article of jewelry can be another suitable decorative item (e.g., a bracelet, ring, band, bangle, armlet, crown, anklet, etc.) or engages another feature of a user (e.g., hand, arm, head, beck, ankle, foot, etc.).

Figure 3A:
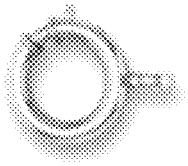
FIG. 3A-3L are illustrations of interlocking components of the jewelry system of FIG. 1, according to an exemplary embodiments.
Figure 3B:
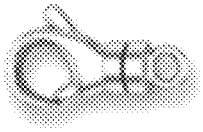

As shown in FIG. 1, the necklace 102 includes a first end 110 and a second end 112. In an exemplary embodiment, the first end 110 and the second end 112 include an interlocking component, for example to couple the first end 110 or the second end 112 to another component or device. As shown, the first end 110 includes a ring 120 and the second end 112 includes a hook 122. In an exemplary embodiment, the ring 120 is configured to receive a hook or another interlocking component, and the hook 122 is configured to engage a ring or another interlocking component. For example, the ring 120 may selectively receive and release the hook 122, such that a user may selectively fit the necklace 102 to and from their body (e.g., neck, etc.). In an exemplary embodiment, the ring 120 is configured to receive a hook of the clasp 104, or the hook 122 is configured to engage a ring of the clasp 104, for example to couple the necklace 102 to the clasp 104 to allow a user to fit the necklace 102 to their body. In an exemplary embodiment, the ring 120 is a jump ring and the hook 122 is a lobster clasp (e.g., as shown in at least FIG. 3B).

Figure 3C:
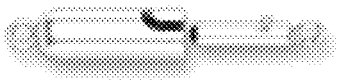
Figure 3D:
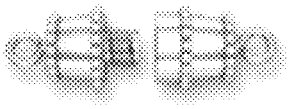
Figure 3E:
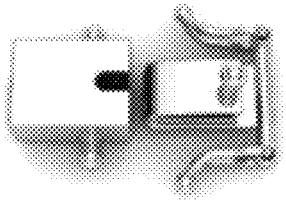
Figure 3F:
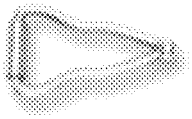
Figure 3G:
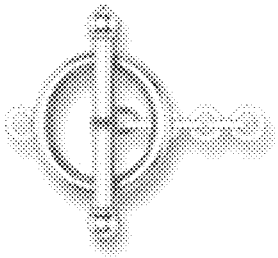
Figure 3H:
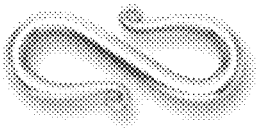
Figure 3I:
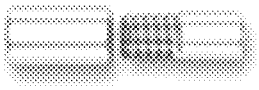
Figure 3J:
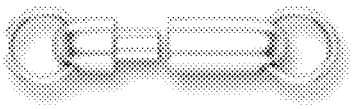
Figure 3K:
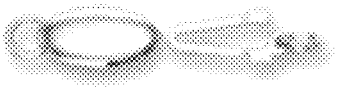
Figure 3L:
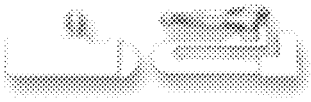

It should be understood that while the first end 110 is described herein as including a ring 120 and the second end 112 is described herein as including a hook 122, it is contemplated that in other embodiments the interlocking components are other suitable interlocking or coupling components. For example, the interlocking components can be a spring ring (e.g., as shown in at least FIG. 3A), a bayonet clasp (e.g., as shown in at least FIG. 3C), a barrel clasp (e.g., as shown in at least FIG. 3D), an open box clasp (e.g., as shown in at least FIG. 3E), a FIG. 8 safety clasp (e.g., as shown in at least FIG. 3F), a toggle clasp (e.g., as shown in at least FIG. 3G), an s-hook (e.g., as shown in at least FIG. 3H), a mystery clasp (e.g., as shown in at least FIG. 3I), a magnetic clasp (e.g., as shown in at least FIG. 3J), a pearl clasp (e.g., as shown in at least FIG. 3K), a bracelet catch (e.g., as shown in at least FIG. 3L), a latch, hook, magnet, pin, sleeve, or other suitable configurations.

Figure 2:
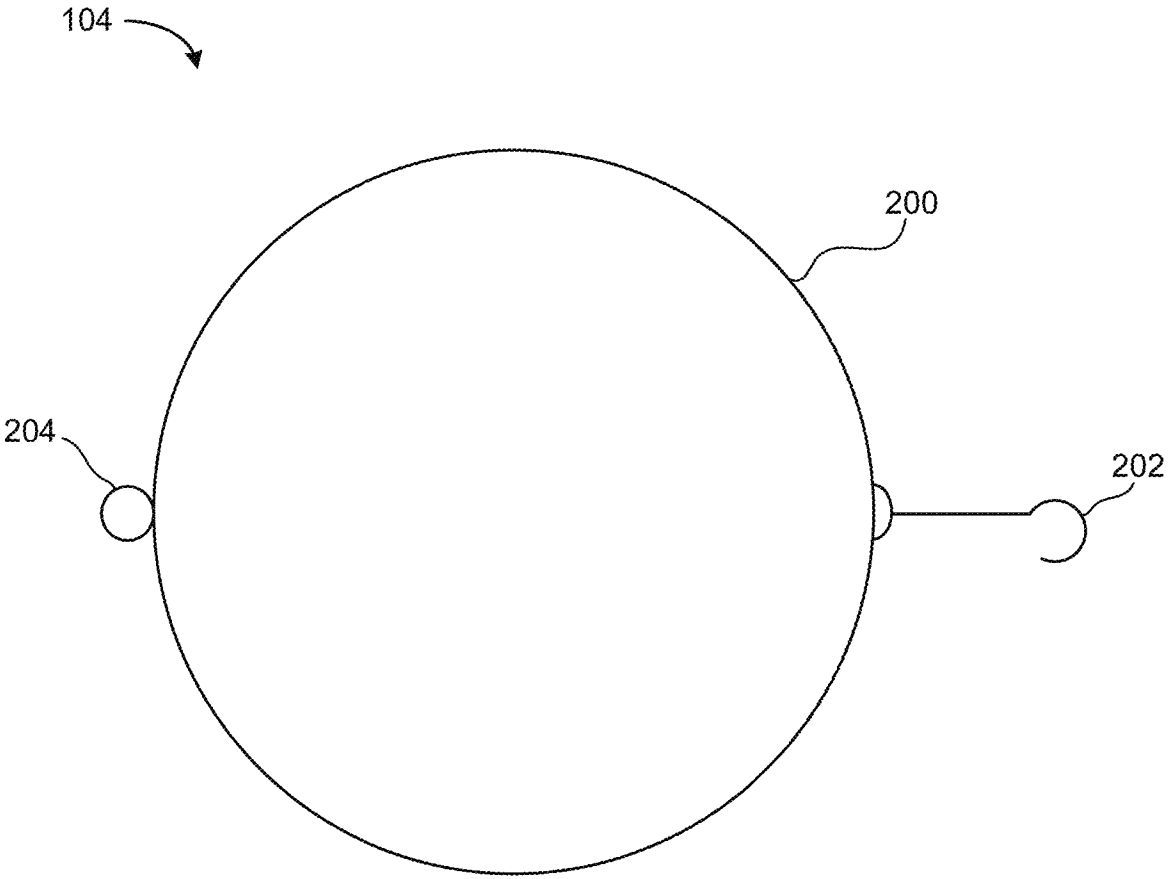
FIG. 2 is an illustration of the clasp of the jewelry system of FIG. 1, according to an exemplary embodiment.

Referring now to FIG. 2, the clasp 104 is shown in greater detail. According to an exemplary embodiment, the clasp 104 includes a housing 200, a first interlocking component, shown as clasp hook 202, and a second interlocking component, shown as clasp ring 204. The housing 200 may be circular or spherical in shape and may define an interior volume, for example to house one or more components of the clasp 104 (e.g., a spring, cord, magnet, etc.). In an exemplary embodiment, the housing 200 is formed of a metallic material and is between 2.5 and 10 millimeters in diameter. For example, the housing 200 may be formed of titanium and may have a diameter of 5 millimeters.

In some embodiments, the housing 200 (or other components of the clasp 104) is formed of one or more materials, for example specific to one or more individuals. For example, the housing 200 or other components of the clasp 104 may be formed of one or more hypoallergenic materials (e.g., titanium, surgical steel, a coated alloy, a protective coating, a protective or treated surface, etc.), for example for an individual with sensitive skin or allergies. In some embodiments, the housing 200 (or other components of the clasp 104) is formed of another suitable material (e.g., gold, yellow gold, white gold, rose gold, brass, silver, titanium, platinum, palladium, copper, resin, acrylic, tungsten, carbon fiber, silicone, recycled metals, organic metals, etc.). In some embodiments, the housing 200 is another suitable shape or size (e.g., 5 millimeter diameter, 10 millimeter diameter, 25 millimeter diameter, between 5-30 millimeters in diameter, or another suitable size or configuration, etc.).

In some embodiments, the housing 200 includes one or more modular layers, surfaces, materials, or interfaces. For example, the housing 200 may include an exterior modular layer or surface, for example to permit removal or replacement of an exterior surface of the housing 200 (e.g., to allow an individual to remove, replace, customize, etc. an exterior design, shape, color, etc. of the claps, etc.). In some embodiments, the housing 200 includes a connection interface, for example to permit the housing 200 to receive (e.g., couple, engage, etc.) another component at an exterior of the housing 200. For example, the housing 200 may include a connection interface to selectively engage (e.g., couple, de-couple, receive, etc.) an ornamental piece (e.g., a locket, a watch face, a clock face, a decorative pendant, a gemstone, a diamond, a sapphire, an emerald, a stone, etc.), for example to allow an individual to add an additional feature to the exterior of the housing 200.

In some embodiments, the housing 200 includes one or more indicators, symbols, markings, labels, or designs. For example, the housing 200 may include one or more engraved areas (e.g., a floral design, a geometric shape, an abstract design, etc.). In some embodiments, the housing 200 includes one or more designs (e.g., a floral design, an artistic motif, an artistic theme, etc.). The housing 200 may also include one or more inscriptions (e.g., name, initial, time, date, symbol, etc.). In some embodiments, the housing 200 includes one or more colors (e.g., a select color, etc.), includes one or more texture or pattern (e.g., diamond, perforated, grunge, bushed, chrome, rusted, scratched, etc.) or non-texture or pattern areas (e.g., smooth, etc.), or includes one or more finishes (e.g., plated, brushed, polished, blasted, etc.). As described herein, the housing 200 may be formed of one or more metallic materials (e.g., gold, silver, platinum, stainless steel, etc.); however, in some embodiments the housing 200 or components of the clasp 104 are formed of another suitable material (e.g., wood, leather, mixed-materials, etc.).

It should be understood that while the housing 200 is described herein as having a certain shape or configuration, it is contemplated that in other embodiments the housing 200 is another suitable shape (e.g., oval, rectangular, square, triangular, prismatic, etc.), size (e.g., 1.5, 2, 2.5, 3, 5, 7.5, 10, 12.5, 15, etc. millimeters), formed of another suitable material (e.g., silver, gold, platinum, aluminum, etc.), or includes additional or fewer working components.

As shown in FIG. 2, the clasp hook 202 extends from (e.g., engages, is coupled with, etc.) a first portion of the housing 200, and the clasp ring 204 extends from (e.g., engages, is coupled with, etc.) a second portion of the housing 200. For example, the clasp hook 202 and the clasp ring 204 may extend from opposing exterior portions of the housing 200. In an exemplary embodiment, the clasp hook 202 is configured to receive a ring or another interlocking component, and the clasp ring 204 is configured to receive a hook or another interlocking component. For example, the clasp hook 202 may selectively engage a ring (e.g., the ring 120 of the necklace 102), and the clasp ring 204 may selectively receive a hook (e.g., the hook 122 of the necklace 102), for example to couple the clasp 104 to the necklace 102 to allow a user to fit the necklace 102 to their body. In an exemplary embodiment, the clasp hook 202 and the clasp ring 204 are formed of a metal (e.g., titanium, silver, gold, platinum, aluminum, etc.). In an exemplary embodiment, the clasp hook 202 is a lobster clasp (e.g., as shown in at least FIG. 3B) and the clasp ring 204 is a jump ring.

It should be understood that while the clasp hook 202 and the clasp ring 204 are described herein as being a hook and a ring having certain configurations, it is contemplated that in other embodiments the clasp hook 202 or the clasp ring 204 are other suitable interlocking or coupling components. For example, the interlocking components can be a spring ring (e.g., as shown in at least FIG. 3A), a bayonet clasp (e.g., as shown in at least FIG. 3C), a barrel clasp (e.g., as shown in at least FIG. 3D), an open box clasp (e.g., as shown in at least FIG. 3E), a FIG. 8 safety clasp (e.g., as shown in at least FIG. 3F), a toggle clasp (e.g., as shown in at least FIG. 3G), an s-hook (e.g., as shown in at least FIG. 3H), a mystery clasp (e.g., as shown in at least FIG. 3I), a magnetic clasp (e.g., as shown in at least FIG. 3J), a pearl clasp (e.g., as shown in at least FIG. 3K), a bracelet catch (e.g., as shown in at least FIG. 3L), a latch, hook, magnet, pin, sleeve, etc., having another suitable size, shape, or configuration.

In some embodiments, the clasp hook 202 and the clasp ring 204 are magnetic, for example to selectively couple or engage another component (e.g., a ring, a hook, etc.). In this sense, the clasp hook 202 and the clasp ring 204 may be configured to fasten other components (e.g., a magnetic ring, a magnetic hook, another magnetic component, etc.), for example when brought within a predetermined distance or proximity to the other component. In some embodiments, the clasp hook 202 and the clasp ring 204 include one or more locking components (e.g., a locking and unlocking component, etc.). For example, the clasp hook 202 may include a latch or hook, for example to selectively fasten the clasp hook 202 to another component (e.g., a ring, etc.). Similarly, the clasp ring 204 may also include one or more locking components (e.g., a latch, a hook, etc.), for example to selectively fasten the clasp ring 204 to another component (e.g., a hook, etc.). In some embodiments, the locking components are configured to selectively lock and unlock, for example such that the locking components disconnect when subject to certain conditions (e.g., a predetermined amount of force is applied, a threshold amount of force is applied, etc.). In some embodiments, the locking components include additional or different components (e.g., twists, pins, tabs, etc.) configured to selectively lock and unlock, for example such that the locking components prevent unlocking under certain conditions (e.g., provide child-safe locking features to inhibit children from unlocking the components, etc.).

In some embodiments, the clasp hook 202 and the clasp ring 204 include one or more textured surfaces or interfaces. For example, the clasp hook 202 and the clasp ring 204 may include a textured (e.g., knurled, raised, bumpy, ridged, etc.) surface or interface, for example to facilitate tactile identification by an individual (e.g., an individual with a visual impairment or limitation, etc.). In some embodiments, the clasp hook 202 and the clasp ring 204 are incorporated with one or more sensors or sensor systems (e.g., incorporated within the clasp 104, including, for example a gyroscope, an accelerometer, etc.). For example, in response to the clasp hook 202 engaging a ring (e.g., the ring 120 of the necklace 102, etc.) and the clasp ring 204 receiving a hook (e.g., the hook 122 of the necklace 102, etc.), the clasp 104 (e.g., the clasp hook 202, the clasp ring 204, the housing 200, etc.) may provide an indication (e.g., a tactile, an audible, a visual, etc. indication) that the clasp hook 202 and the clasp ring 204 are fastened. In some embodiments, the clasp hook 202 and the clasp ring 204 are determined to be fastened via one or more sensors (e.g., pressure sensor, gyroscope, accelerometer, etc.) within the clasp hook 202, the clasp ring 204, the clasp 104 itself (e.g., the housing 200, etc.) and another suitable sensor or system.

Figure 4:
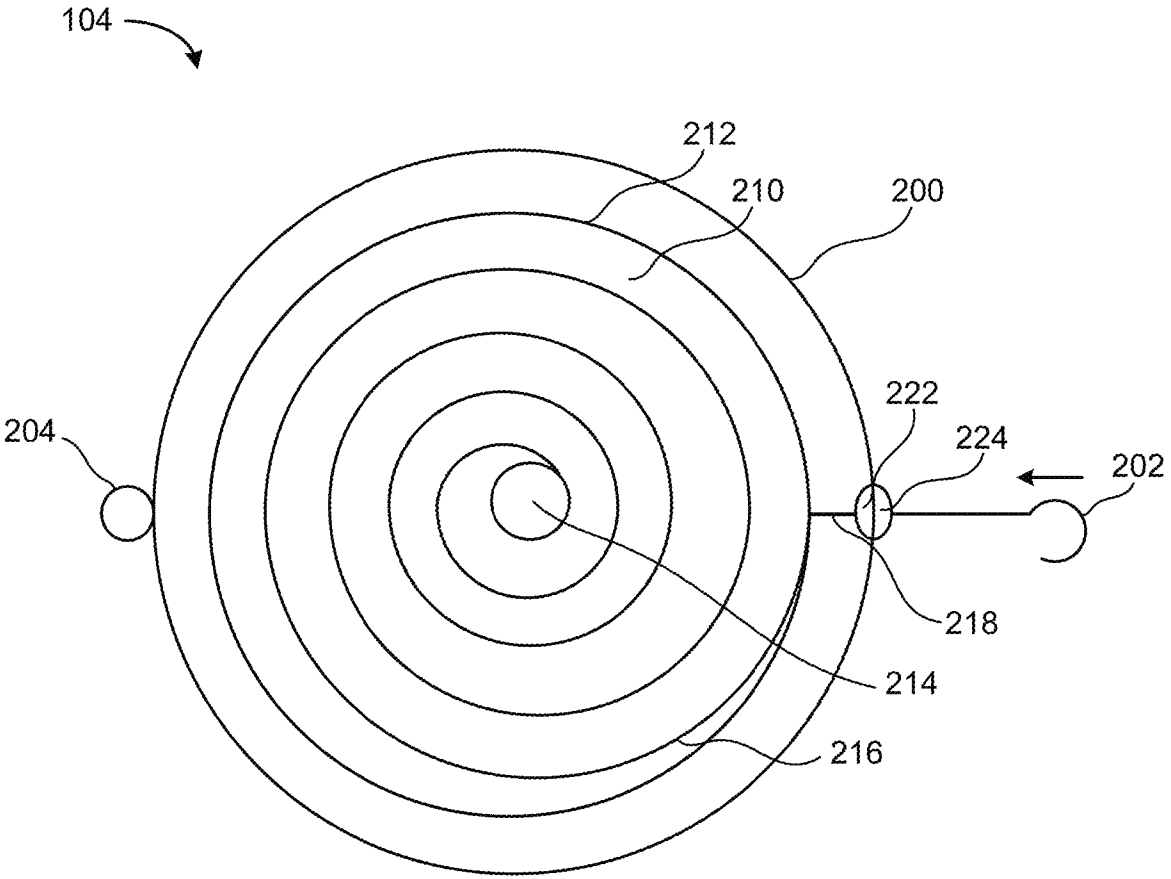
FIG. 4 is an illustration of a cross-sectional view of the clasp of the jewelry system of FIG. 1 in a first configuration, according to an exemplary embodiment.
Figure 5:
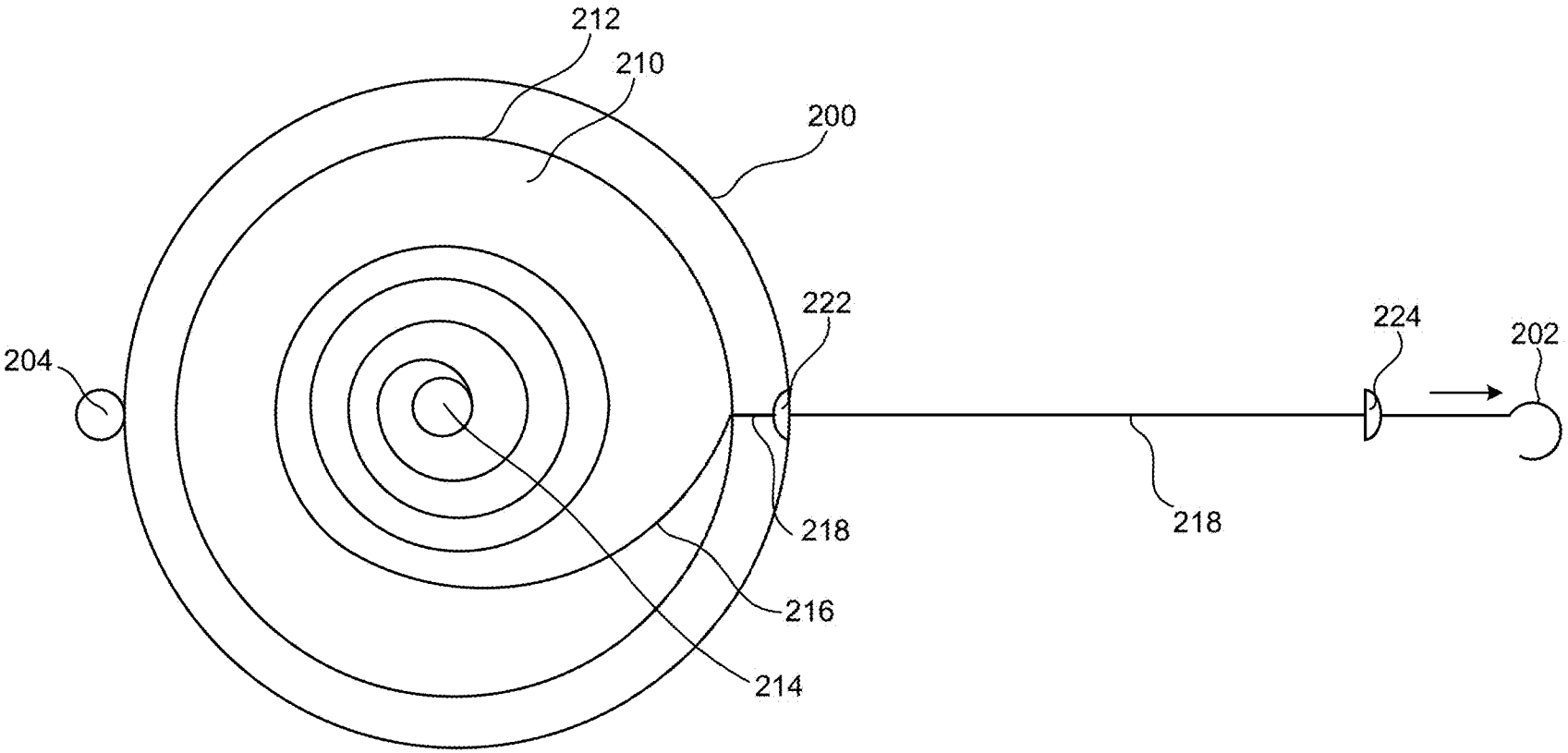
FIG. 5 is an illustration of a cross-sectional view of the clasp of the jewelry system of FIG. 1 is a second configuration, according to an exemplary embodiment.

Referring now to FIGS. 4-5, cross-sectional views of the clasp 104 are shown, according to exemplary embodiments. In an exemplary embodiment, the clasp 104 is configured to transition between a first (e.g., retracted, collapsed, coiled, etc.) configuration (e.g., as shown in at least FIG. 4), and a second (e.g., non-retracted, expanded, un-coiled, etc.) configuration (e.g., as shown in at least FIG. 5). For example, the clasp 104 may couple the necklace 102 in a first (e.g., retracted) configuration. Further, the clasp 104 may transition from the first configuration to a second configuration (e.g., non-retracted, expanded, etc.), for example in response to manipulation of the clasp 104 (e.g., the clasp hook 202, etc.) or the necklace 102 (e.g., repositioning, pulling, moving, etc. the necklace 102). In an exemplary embodiment, the ability of the clasp 104 to transition between a first configuration and a second configuration allows a user to fit the necklace 102 onto their body (e.g., over their head, around their neck, etc.). Further, with the clasp 104 in the second configuration (e.g., a non-retracted, expanded, etc. state), for example on a user (e.g., around a user's neck), the clasp 104 may also transition back to the first configuration (e.g., retracted, coiled, etc.), for example in response to release of the clasp 104 or the necklace 102. As such, the clasp 104 may be configured to transition between first and second configurations any intermediate position therebetween, for example to allow a user to fit the necklace 102 onto their body and secure the necklace 102 on their body once being worn.

It should be understood that while the clasp 104 is shown having certain configurations in FIGS. 4-5, in some embodiments the clasp 104 is otherwise arranged, oriented, or configured. For example, and as shown in FIGS. 4-5, the clasp 104 may transition from the first configuration to a second configuration (e.g., non-retracted, expanded, etc.), for example facilitating the clasp hook 202 extending away from a right exterior portion of the housing 200. In some configurations, the clasp 104 may transition from the first configuration to a second configuration (e.g., non-retracted, expanded, etc.), for example facilitating the clasp hook 202 extending away from another portion of the housing 200 (e.g., a left portion, a top portion, a bottom portion, etc.).

As shown in FIGS. 4-5, the clasp 104 includes a controller, regulator, or actuator, shown as actuator 210. The actuator 210 is shown positioned within the housing 200, and is coupled with the clasp hook 202 (e.g., via a connector or cord, etc.). In an exemplary embodiment, the actuator 210 (e.g., components thereof) is configured to facilitate transitioning the clasp 104 between a first configuration (e.g., retracted) and a second configuration (e.g., non-retracted).

As shown, the actuator 210 includes a case or casing, shown as actuator housing 212, an anchor 214, and a driver, shown as spring 216. In an exemplary embodiment, the actuator housing 212 is circular or round in shape, and includes one or more exterior threads or threading. For example, the actuator housing 212 may be circular and include raised rims or ridges around an exterior circumference of the actuator housing 212, such that the actuator housing 212 forms a spool-like configuration. In an exemplary embodiment, the actuator housing 212 is configured to receive a connector or cord, shown as cord 218. For example, the actuator housing 212 may receive the cord 218 around an exterior circumference of the actuator housing 212, such that the actuator housing 212 is wound with the cord 218 in a spool-like configuration. In some embodiments, the actuator housing 212 receives the cord 218 in another suitable configuration (e.g., through an opening in the actuator housing 212, to an interior of the actuator housing 212, etc.), for example such that the cord 218 is wound, spun, twirled, or otherwise arranged within the actuator housing 212. As shown, the cord 218 is also coupled with the clasp hook 202 at a first end, and may be coupled with the actuator housing 212 at a second end (e.g., an exterior, an interior component, etc.). The cord 218 may also be coupled with one or more additional components of the clasp 104 (e.g., a first magnet, a second magnet, etc.). In some embodiments, the cord 218 is formed of at least one of nylon, polyester, Dyneema, steel wire, polyurethane, elastic, braided cord, thermoplastic elastomers, and spectra. However, it will be appreciated that the cord 218 can be formed of any suitable materials.

As shown, the actuator housing 212 also houses or contains the anchor 214, the spring 216, or one or more additional components (e.g., a connector or cord, the cord 218, etc.). In an exemplary embodiment, the anchor 214 is coupled with the actuator housing 212, the spring 216, and the housing 200. For example, the anchor 214 may couple the actuator housing 212 and the housing 200 to position the actuator 210 relative to the housing 200 (e.g., about a center point of the housing 200, at a center of the housing 200, etc.). The anchor 214 may also couple the actuator housing 212 and the spring 216, for example to position the spring 216 relative to the actuator housing 212. In an exemplary embodiment, the anchor 214 is coupled with a first end of the spring 216 and a center portion (e.g., center point, central axis point, etc.) of the actuator housing 212, such that the anchor 214 centers the spring 216 relative to the actuator housing 212. For example, the anchor 214 may center the spring 216 relative to the actuator housing 212 such that an axis of the spring 216 is aligned with an axis of the actuator housing 212 (e.g., a rotational axis of the spring is aligned or co-axially aligned with a central axis of the housing 200).

In an exemplary embodiment, the spring 216 is coupled with the anchor 214 and is configured to control movement (e.g., a position, orientation, configuration, etc.) of the clasp hook 202. For example, the spring 216 may be a coil spring coupled with the anchor 214 at a first end and the actuator housing 212 at a second end. The spring 216 may also be configured to bias between a first configuration (e.g., in an expanded state) and a second configuration (e.g., in a compressed, non-expanded, etc. state). For example, the spring 216 may be coupled with the anchor 214 and the actuator housing 212, such that in the first configuration (e.g., in an expanded state) the spring 216 exerts a force (e.g., rotational force, biasing force, etc.) on the actuator housing 212 to force the housing into a first configuration. In the first configuration, the actuator housing 212 (e.g., via the spring 216) may be wrapped in the cord 218 (or the cord 218 may be wrapped within the actuator housing 212), such that the clasp hook 202 and the cord 218 is drawn toward the housing 200 (as shown in at least FIG. 4). In response to a manipulation of the clasp hook 202 or the necklace 102 (e.g., via a user or operator), the spring 216 may transition to the second configuration. In the second configuration, the cord 218 may be drawn away from the housing 200 (as shown in at least FIG. 5), and the spring 216 may impart a resistive force (e.g., via a rotation of the actuator housing 212) on the cord 218 or the actuator housing 212, to limit or prevent movement of the clasp hook 202 away from the housing 200. In an exemplary embodiment, when the manipulation is released from the clasp hook 202 or the necklace 102, the spring 216 may again return to the first configuration, thereby drawing the clasp hook 202 and the cord 218 back toward the housing 200 (as shown in FIG. 4).

In some embodiments, the clasp 104 (e.g., the actuator 210, etc.) includes additional, fewer, or different working components. For example, the clasp 104 (e.g., the actuator 210, etc.) may include a regulator. In some embodiments, the regulator is configured to control (e.g., establish, set, determine, etc.) a configuration of the cord 218, for example relative to one or more components of the clasp 104. For example, the regulator may control a length of the cord 218 (e.g., a length of the cord 218 outside of the housing 200), such that a section of the cord 218 is adjustable or customizable (e.g., a section of the cord 218 outside the housing 200). In this sense, the regulator may control or adjust a length of the cord 218 that is outside the housing 200 when the spring 216 is in the first configuration (e.g., an expanded state with a portion of the cord 218 wound within the actuator housing 212, etc.).

In some embodiments, the clasp 104 (e.g., the actuator 210, etc.) includes a quick-release connection. For example, the cord 218 may be coupled with the anchor 214, the actuator housing 212, or another suitable component via the quick-release connection. The quick-release connection may be configured to selectively release, for example in response to a predetermined force or strength applied to the cord 218. The quick-release connection may permit the cord 218 to disconnect (e.g., de-couple, etc.) from the anchor 214, the actuator housing 212, etc., for example to facilitate rapid disconnection of the cord 218 (e.g., in an emergency situation, etc.). In some embodiments, the clasp 104 includes another suitable quick-release connection or mechanism (e.g., a quick-release button, a release tab or switch, etc.), for example to permit one or more components of the clasp 104 (e.g., the cord 218, the clasp hook 202, the clasp ring 204, etc.) to disconnect (e.g., de-couple, etc.) from another component (e.g., the housing 200, etc.).

Referring still to FIGS. 4-5, the clasp 104 also includes at least one fastener, according to an exemplary embodiment. As shown, the clasp 104 includes a first fastener, shown as a first magnet 222, and a second fastener, shown a second magnet 224. According to an exemplary embodiment, the first magnet 222 is coupled to an interior surface of the housing 200, for example, at the second portion of the housing 200 (e.g., adjacent the clasp hook 202, etc.). The second magnet 224 may be coupled to the cord 218, for example, a predetermined distance from the clasp hook 202. According to an exemplary embodiment, the first magnet 222 and the second magnet 224 are arranged such that opposing poles of the magnets 222, 224 are facing one another, such that the first magnet 222 and the second magnet 224 attract. As shown in FIGS. 4-5, the first magnet 222 and the second magnet 224 are configured to selectively couple. For example, when the clasp is in the first configuration (e.g., retracted configuration, etc.) the clasp hook 202 and the cord 218 is drawn toward the housing 200, such that the first magnet 222 is configured to couple with the second magnet 224 (as shown in FIG. 4). Conversely, in the second configuration (e.g., non-retracted, expanded configuration, etc.) the clasp hook 202 and the cord 218 is drawn away from the housing 200, such that the second magnet 224 is configured to de-couple the first magnet 222 (as shown in FIG. 5). In an exemplary embodiment, the first magnet 222 and the second magnet 224 are configured to attract (e.g., selectively couple, etc.) to secure the clasp hook 202 relative to the housing 200, for example to secure the clasp 104 (e.g., the necklace 102) on the body of a user once it is being worn. While the at least one fastener is described herein as being a first magnet 222 and a second magnet 224, it is contemplated that in other embodiments the magnets 222, 224 are other suitable fastener components (e.g., hooks, loops, pins, sleeves, etc.).

Figure 6:
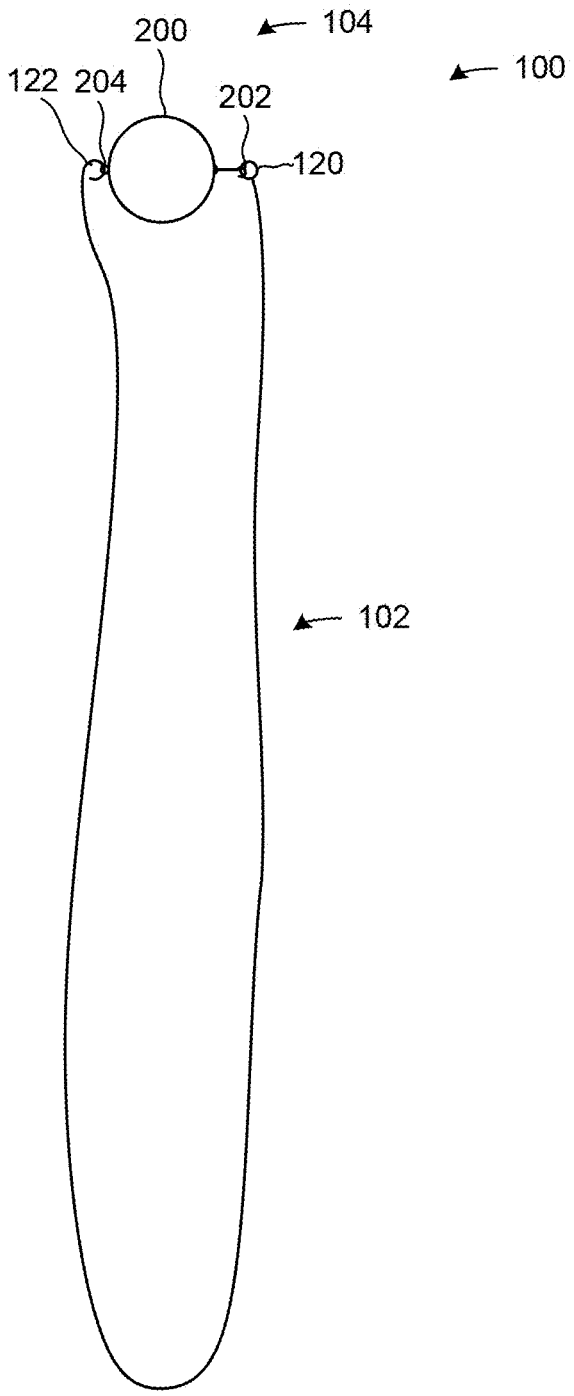
FIG. 6 is an illustration of the necklace and the clasp of the jewelry system of FIG. 1 in a first configuration, according to an exemplary embodiment.
Figure 7:
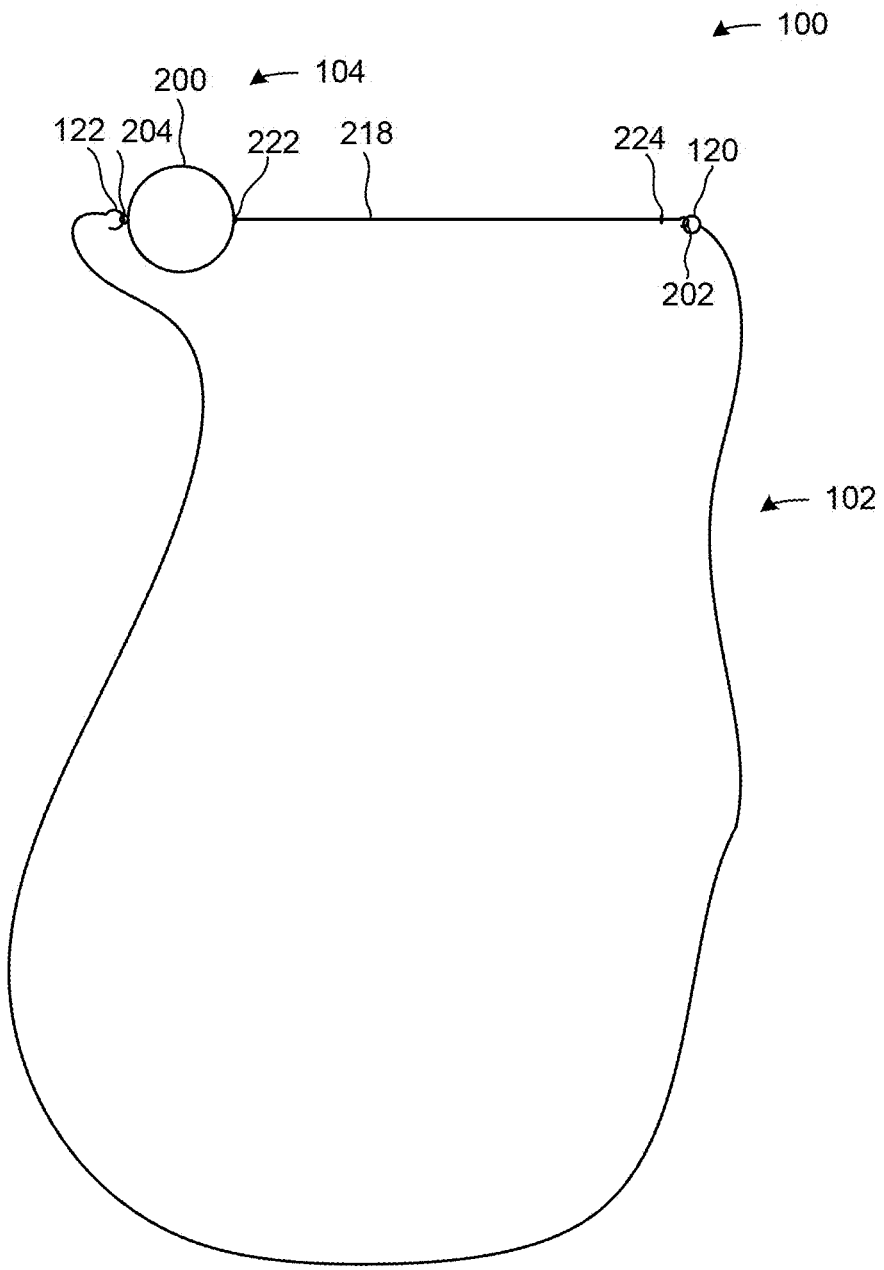
FIG. 7 is an illustration of the necklace and the clasp of the jewelry system of FIG. 1 in a second configuration, according to an exemplary embodiment.

Referring now to FIGS. 6-7, illustrative views of various configurations of the jewelry system 100 are shown, according to exemplary embodiments. As shown, the jewelry system includes the clasp 104 and the necklace 102. As shown in FIG. 6, the clasp 104 may be in a first configuration, for example in a retracted configuration with the clasp hook 202 (e.g., and the cord 218) being drawn toward the housing 200. With the clasp 104 in the first configuration, the necklace 102 may be coupled with the clasp 104. For example, the ring 120 may receive the clasp hook 202, and the hook 122 may engage the clasp ring 204, such that the necklace 102 is coupled with the clasp 104 (as shown in at least FIG. 6).

As shown in FIG. 7, in response to a manipulation or force, the clasp 104 may transition from the first configuration to a second configuration. For example, in response to a manipulation of the clasp hook 202 or the necklace 102, the clasp 104 may move to a non-retracted or expanded state. As the clasp hook 202 is drawn away from the housing 200, the cord 218 may be drawn from the housing 200 (e.g., the actuator housing 212). Further, the second magnet 224 may de-couple the first magnet 222, such that the clasp hook 202 may continue to move away from the housing 200. However, as the clasp hook 202 is drawn away from the housing 200, the spring 216 may exert a resistive force on the cord 218 or the actuator housing 212, for example to resist movement of the clasp hook 202 or the cord 218. With the clasp 104 in the second configuration (e.g., expanded configuration), the necklace 102 can be fit onto the body of the user (e.g., over the user's head, around their neck, etc.).

According to an exemplary embodiment, with the necklace 102 (and clasp 104) fit onto the body of the user, the manipulation or force may be released from the clasp 104. As the force is released, the clasp 104 may transition from the second configuration back to the first configuration. For example, the spring 216 may apply a force to the cord 218 or the actuator housing 212, thereby drawing the cord 218 back toward the housing 200. As the cord 218 and the clasp hook 202 are drawn back toward the housing 200, the second magnet 224 may be drawn to the first magnet 222 (e.g., via opposing polar faces, etc.). The second magnet 224 may couple the first magnet 222, thereby securing the clasp 104 back in the first configuration (e.g., the retracted configuration). In an exemplary embodiment, the coupling formed by the magnets 222, 224 more adequately fit and secure the necklace 102 to the body of the user.

Referring generally to FIGS. 8-14, one or more components of a jewelry system are shown, according to an exemplary embodiment. In some embodiments, the jewelry system is the jewelry system 100 of FIGS. 1-7. In this regard, the one or more components of FIGS. 8-14 may be utilized or implemented with any or all of the components of the jewelry system 100 of FIGS. 1-7 (e.g., the ring 120, the hook 122, the clasp hook 202, the clasp ring 204, the cord 218, etc.). Similarly, one or more components of FIGS. 15-18 may be utilized or implemented with any or all of the components of the jewelry system 100 of FIGS. 1-7 (e.g., the ring 120, the hook 122, the clasp hook 202, the clasp ring 204, the cord 218, etc.).

Referring to FIGS. 8-14, a clasp 504 is shown, according to an exemplary embodiment. As shown in FIGS. 8-14, the clasp 504 includes a housing 600 and a controller, regulator, or actuator, shown as actuator 610 (e.g., as shown in at least FIG. 9), which is shown to include a case or casing, shown as actuator housing 612, and a driver, shown as spring 616. As described herein, the clasp 504 may be configured to transition between a first configuration (e.g., retracted, collapsed, coiled, etc.) and a second configuration (e.g., non-retracted, expanded, un-coiled, etc.), for example to allow a user to fit a piece of jewelry onto their body (e.g., over their head, around their neck, over their hand, on their wrist, etc.).

As also described herein, the clasp 504 may be implemented with any or all of the components of the jewelry system 100. For example, the clasp 504 (e.g., the housing 600) may include a first interlocking component (e.g., a clasp hook, the clasp hook 202, etc.) and a second interlocking component (e.g., a clasp ring, the clasp ring 204, etc.). In some embodiments, the first interlocking component (e.g., the clasp hook 202, etc.) may extend from a first portion of the clasp 504 (e.g., the housing 600) and the second interlocking component (e.g., the clasp ring 204) may extend from a second portion of the clasp 504 (e.g., the housing 600), as described herein. In some embodiments, one of the first interlocking component (e.g., the clasp hook 202) or the second interlocking component (e.g., the clasp ring 204) is movable (e.g., relative to the clasp 504, relative to the housing 600), for example as the clasp 504 transitions between the first configuration and the second configuration. In some embodiments, one of the first interlocking component or the second interlocking component is fixed relative to the clasp 504 (e.g., the housing 600).

Figure 8:
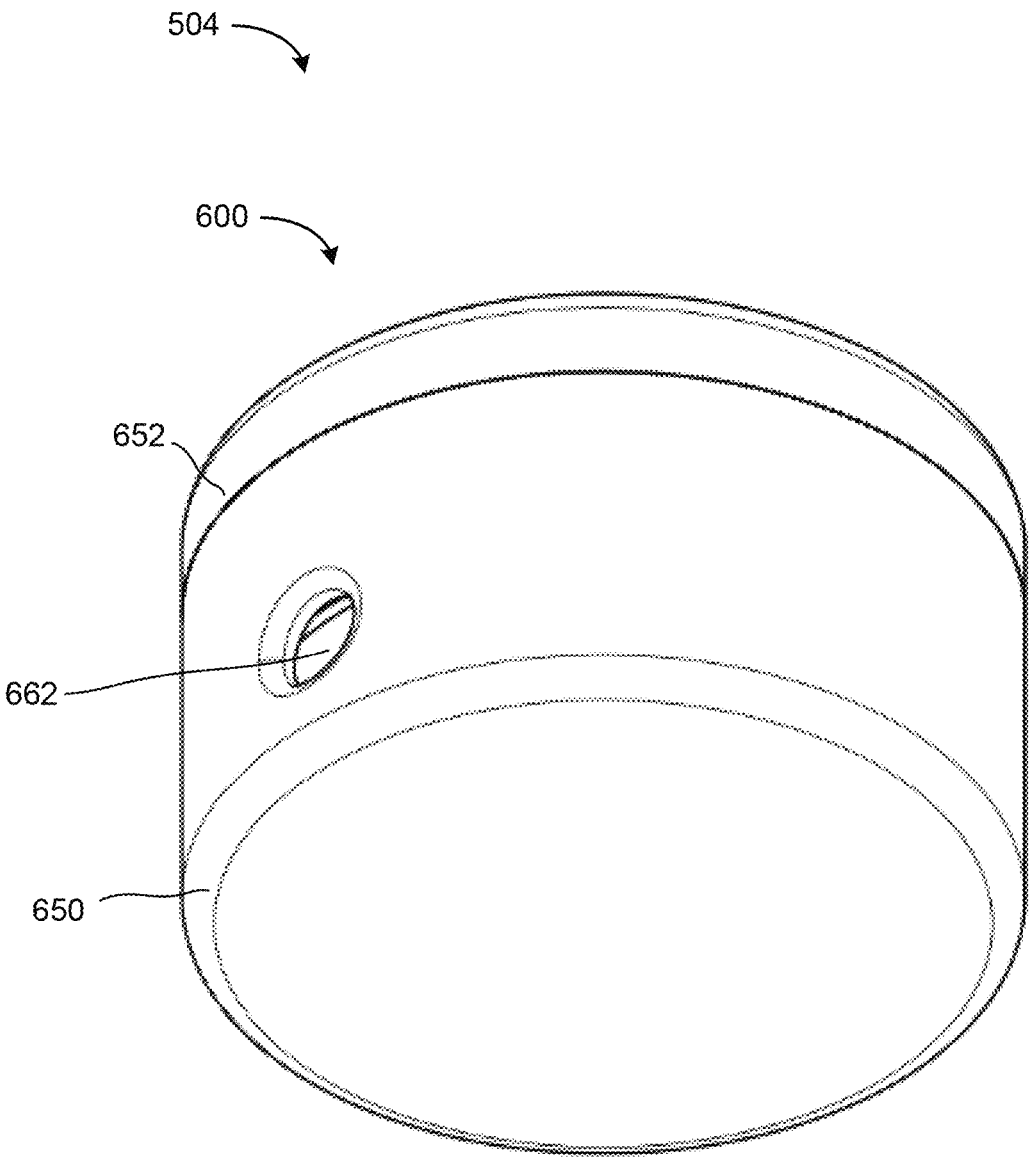
FIG. 8 is an illustration of a bottom perspective view of a clasp of the jewelry system of FIG. 1, according to an exemplary embodiment.
Figure 9:
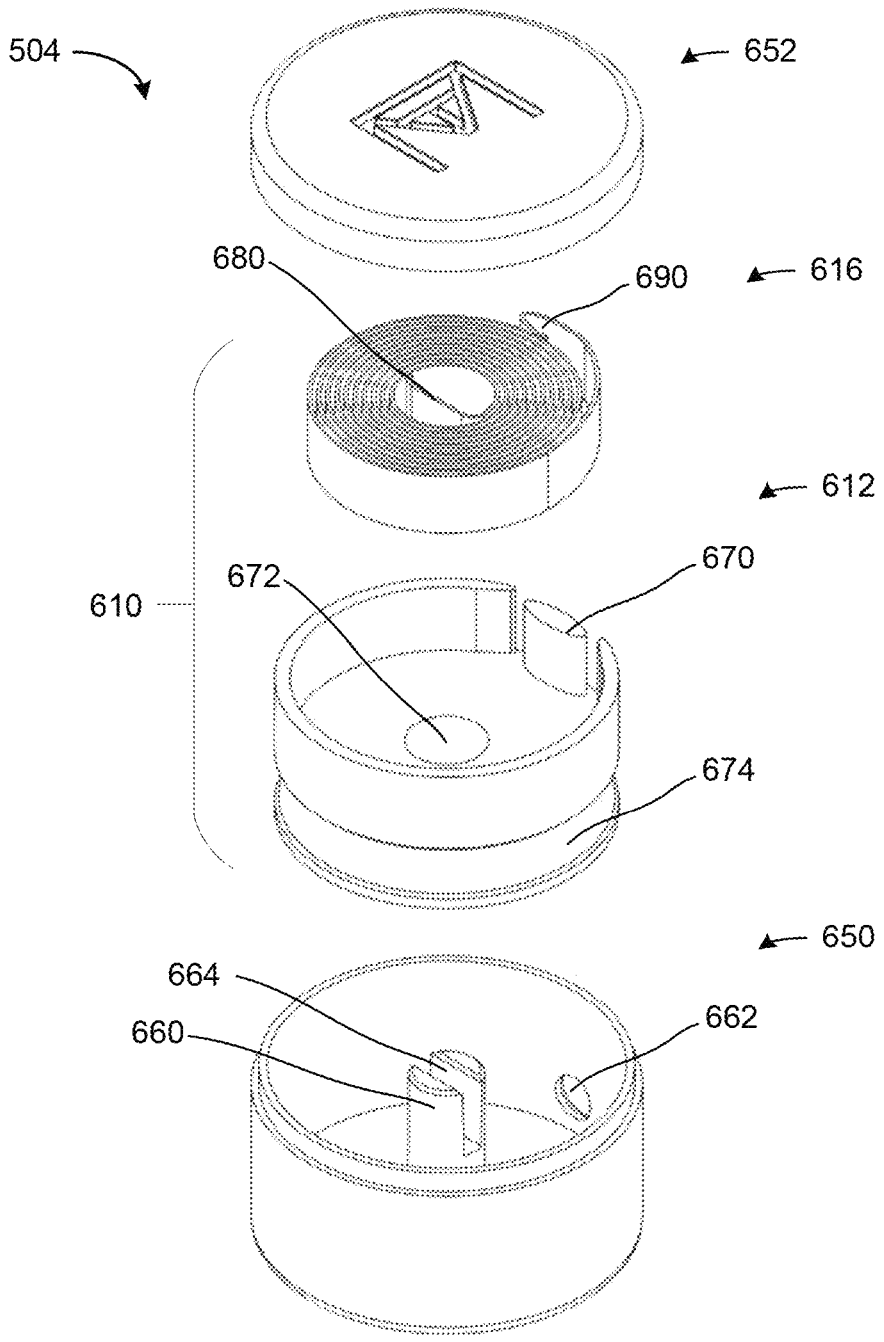
FIG. 9 is an exploded view of the clasp of FIG. 7, according to an exemplary embodiment.
Figure 10:
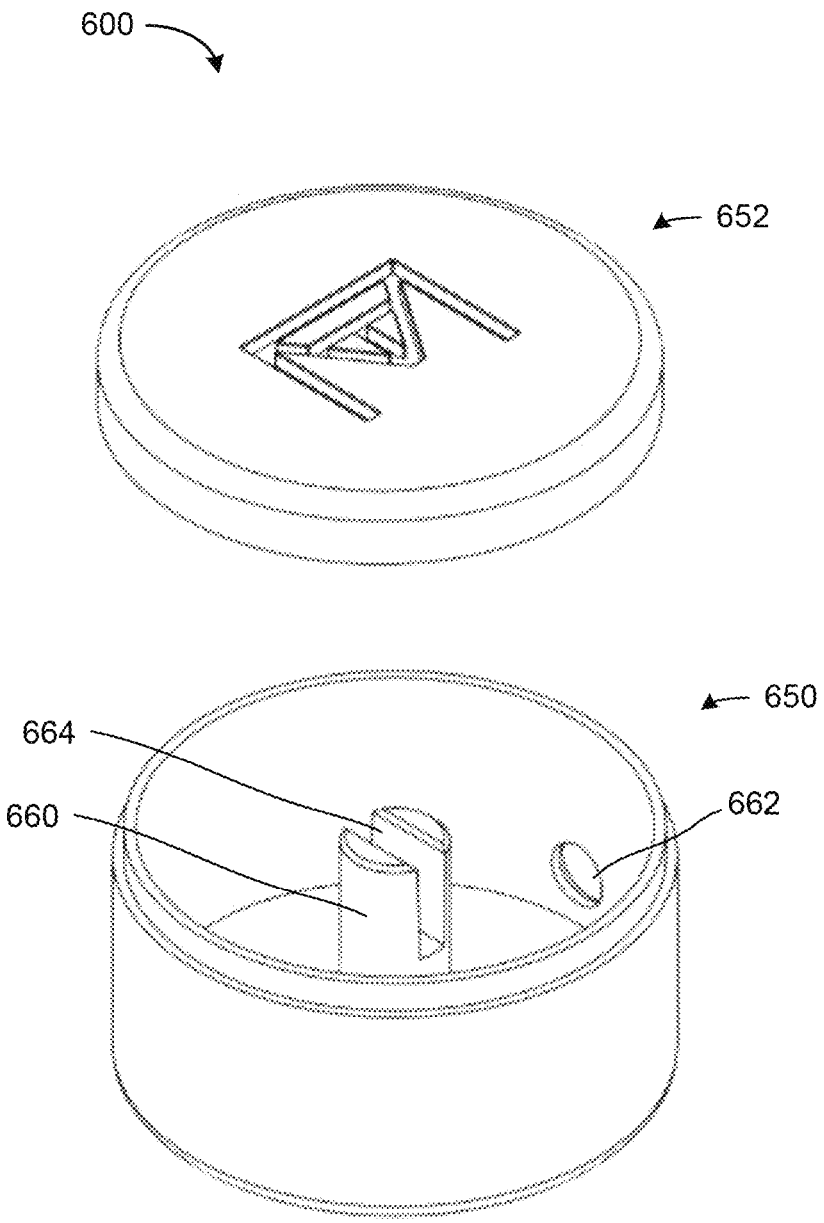
FIG. 10 is an exploded view of a housing of the clasp of FIG. 7, according to an exemplary embodiment.

As shown in at least FIGS. 8-10, the housing 600 includes a bottom or lower portion, shown as housing bottom 650, and a top or upper portion, shown as housing top 652. The housing bottom 650 and the housing top 652 may be configured to selectively couple (e.g., couple, de-couple, etc.), for example to facilitate assembly of the housing 600 (or the clasp 504, including the actuator 610, etc.). As described herein, the housing 600 (e.g., the housing bottom 650, the housing top 652, etc.) may be formed of any suitable material or materials (e.g., hypoallergenic materials, metal, etc.), or may have any suitable shape, size, or configuration (e.g., have a spherical or circular shape, be formed of titanium, have a diameter of 5 millimeters, etc.). Further, and as also described herein, the housing 600 (e.g., the housing bottom 650, the housing top 652, etc.) may include one or more modular layers, surfaces, materials, or interfaces, which may be or include one or more indicators, symbols, markings, labels, or designs.

As shown in at least FIGS. 9-10, the housing bottom 650 includes an anchor 660 and an aperture or opening, shown as hole 662. The anchor 660 may be a projection, protrusion, post, or pole. The anchor 660 may include a recess, depression, cut, or groove, shown as groove 664. The groove 664 may extend into the anchor 660, for example into a surface of the anchor 660 (e.g., a top surface, etc.) parallel with an axis of the anchor 660 (e.g., a central axis of the anchor 660). The groove 664 may also be positioned or oriented relative to one or more components of the housing bottom 650. For example, the groove 664 may be disposed perpendicular to the hole 662 (e.g., as shown in at least FIG. 9), may extend in a direction perpendicular to a bottom or bottom surface of the housing bottom 650, or may otherwise be positioned or oriented.

According to an exemplary embodiment, the anchor 660 is configured to couple (e.g., receive, engage, etc.) a component of the clasp 504 (e.g., a driver, the spring 616, etc.). For example, the anchor 660 (e.g., the groove 664, etc.) may be configured to couple (e.g., receive, engage, etc.) a driver of the clasp 504 (e.g., the spring 616), for example to anchor the driver (e.g., the spring 616) relative to the housing 600 (e.g., the housing bottom 650, etc.). In an exemplary embodiment, and as described herein, the anchor 660 (e.g., the groove 664, etc.) is configured to couple the driver (e.g., the spring 616), for example to facilitate transitioning the driver (e.g., the spring 616) between one or more configurations (e.g., a coiled configuration, an un-coiled configuration, etc.). As shown, the anchor 660 is positioned at a central portion of the housing bottom 650 (e.g., a center of a bottom of the housing bottom 650, a central axis of rotation of the housing bottom 650, etc.). It should be understood that while the anchor 660 is described as a projection positioned at a central portion of the housing bottom 650, it is contemplated that in some embodiments the anchor 660 is otherwise shaped, sized, configured, or positioned.

As also shown in at least FIGS. 9-10, and as described herein, the housing bottom 650 includes the hole 662. The hole 662 may be formed in an exterior wall of the housing bottom 650. As shown, the hole 662 may be positioned at a lower portion of an exterior wall of the housing bottom 650 (e.g., toward a bottom or bottom surface of the housing bottom 650, etc.). According to an exemplary embodiment, the hole 662 is configured to facilitate movement of a cord relative to the housing 600 (e.g., the housing bottom 650). For example, the hole 662 may facilitate movement of a cord (e.g., the cord 218, etc.) out of and into the housing bottom 650, for example as the clasp 504 transitions between one or more configurations (e.g., a non-expanded configuration, an expanded configuration, etc.), as described herein. It should be understood that while the hole 662 is described as an opening in a lower portion of an exterior wall of the housing bottom 650, it is contemplated that in some embodiments the hole 662 is otherwise shaped, sized, configured, or positioned.

As shown in FIG. 9, and as briefly described herein, the actuator 610 is shown to include a case or casing, shown as the actuator housing 612, and a driver, shown as the spring 616. According to an exemplary embodiment, the actuator 610 is configured to be positioned within the housing 600. Further, and as described herein, the actuator 610 may be configured to transition (e.g., bias, move, rotate, etc.) between one or more configurations, for example to facilitate transitioning the clasp 504 between a first configuration (e.g., a retracted configuration, etc.) and a second configuration (e.g., a non-retracted configuration).

Figure 11:
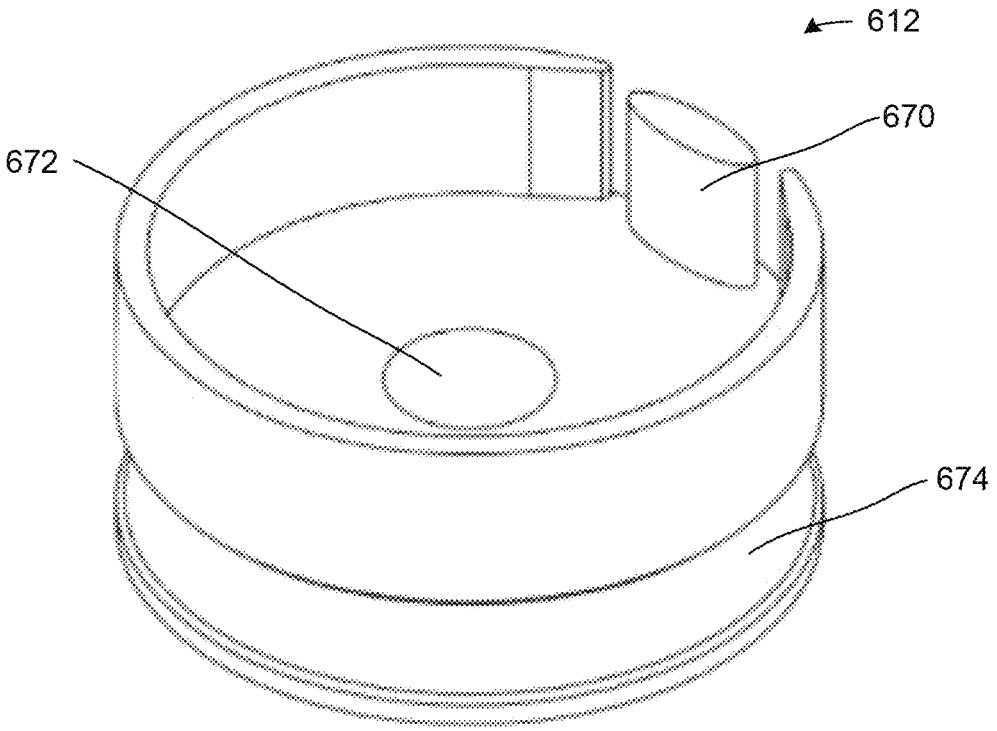
FIG. 11 is a perspective view of an actuator housing of the clasp of FIG. 7, according to an exemplary embodiment.

As shown in at least FIGS. 9 and 11, the actuator housing 612 is a circular or round shape. The actuator housing 612 is shown to include an anchor 670, a hole or aperture, shown as opening 672, and a connector interface 674. In an exemplary embodiment, the anchor 670 is a projection, protrusion, post, or pole. The anchor 670 may be configured to couple (e.g., receive, engage, etc.) a component of the clasp 504 (e.g., a driver, the spring 616, etc.). According to an exemplary embodiment, the anchor 670 is configured to couple (e.g., receive, engage, etc.) a driver of the clasp 504 (e.g., the spring 616), for example to anchor the driver (e.g., the spring 616) relative to the actuator housing 612. According to an exemplary embodiment, the anchor 670 is also configured to couple a driver of the clasp 504 (e.g., the spring 616) to facilitate transitioning the driver (e.g., the spring 616) between one or more configurations (e.g., a coiled configuration, an un-coiled configuration, etc.). In this regard, and as explained herein, the driver (e.g., the spring 616) may be coupled with the anchor 660 (e.g., via the groove 664, etc.) of the housing bottom 650 (e.g., at a first end, etc.) and the anchor 670 of the actuator housing 612 (e.g., at a second end, etc.), for example can facilitate transitioning (e.g., biasing, etc.) the driver (e.g., the spring 616) between one or more configurations (e.g., a coiled configuration, an un-coiled configuration, etc.). The anchor 670 may be positioned at an exterior portion of the actuator housing 612, though it is contemplated that in some embodiments the anchor 670 is otherwise shaped, sized, configured, or positioned.

As shown in at least FIGS. 9 and 11, the actuator housing 612 includes the opening 672. The opening 672 may extend through a bottom or bottom surface of the actuator housing 612 or may be positioned at a central portion of the actuator housing 612 (e.g., a center of a bottom of the actuator housing 612, a central axis of rotation of the actuator housing 612, etc.). According to an exemplary embodiment, the opening 672 is configured to receive a component of the clasp 504. For example, the opening 672 may be configured to receive the anchor 660 of the housing bottom 650. In this regard, the actuator housing 612 may be positioned within the housing 600 (e.g., the housing bottom 650, etc.), such that the anchor 660 extends through the opening 672, for example to position the actuator housing 612 relative to the housing bottom 650 (e.g., to center the actuator housing 612 relative to the housing bottom 650, position the actuator housing 612 about a central axis of the housing bottom 650, etc.).

As shown in FIGS. 9 and 11, the actuator housing 612 includes the connector interface 674. The connector interface 674 is shown to extend into and around an exterior surface of the actuator housing 612. The connector interface 674 may be positioned at a bottom portion of an exterior surface and wall of the actuator housing 612. According to an exemplary embodiment, the connector interface 674 is configured to engage (e.g., receive, couple, de-couple, etc.) a connector or cord (e.g., the cord 218). For example, the connector interface 674 may be configured to receive a cord (e.g., the cord 218), such that the cord is wound around the actuator housing 612 in a spool-like configuration. In some embodiments, the connector interface 674 engages the connector or cord in another suitable configuration (e.g., through an opening, at an interior surface of the actuator housing 612, etc.), for example such that the cord is otherwise wound, spun, twirled, or otherwise arranged. It should be understood that while the connector interface 674 is described as a recess that extends into and around a lower exterior surface of the actuator housing 612, it is contemplated that in some embodiments the connector interface 674 is otherwise shaped, sized, configured, or positioned (e.g., includes grooves or ridges, extends around an upper portion, extends around a middle portion, etc.).

Figure 12:
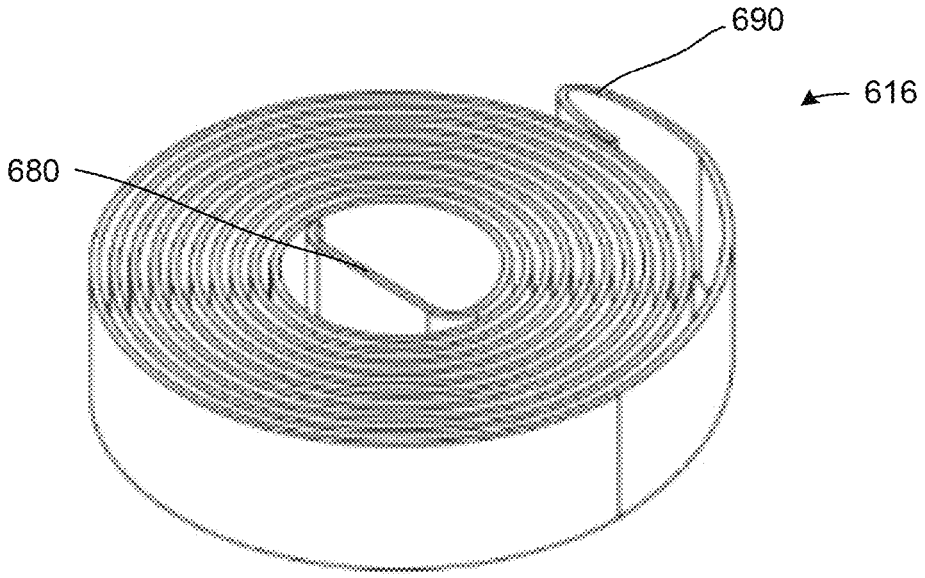
FIG. 12 is a perspective view of a driver of the clasp of FIG. 7, according to an exemplary embodiment.
Figure 13:
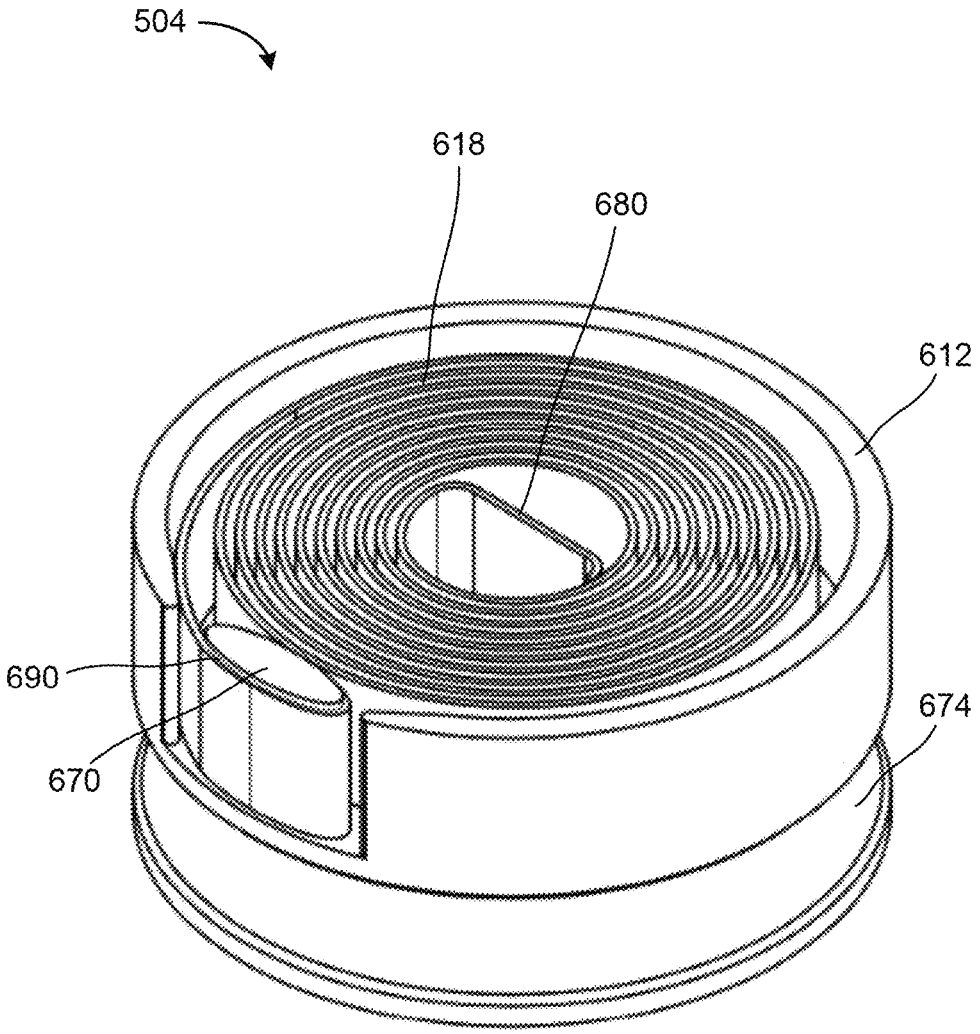
FIG. 13 is a perspective view of an actuator housing and a driver of the clasp of FIG. 7, according to an exemplary embodiment.
Figure 14:
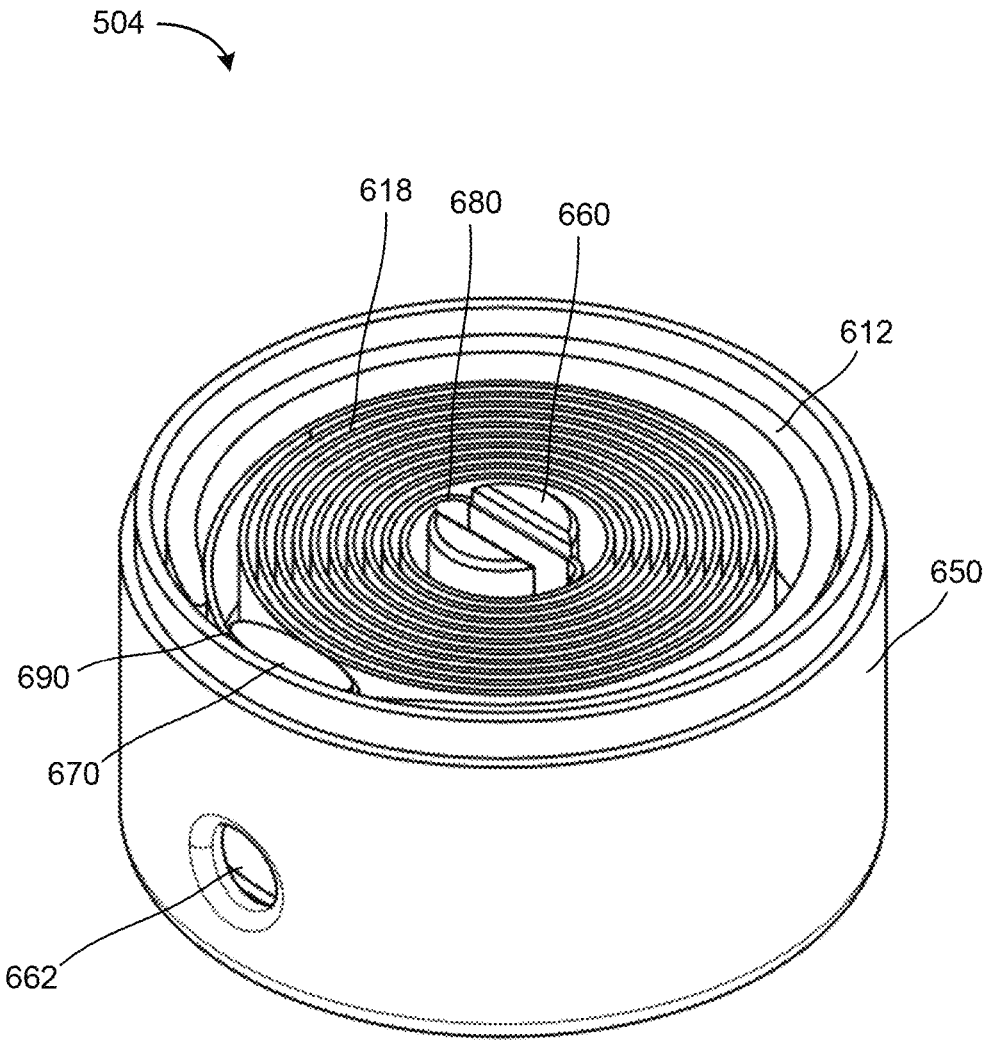
FIG. 14 is a perspective view of an actuator and a housing bottom of the clasp of FIG. 7, according to an exemplary embodiment.

As shown in FIGS. 9 and 12, the actuator 610 includes a driver, shown as the spring 616. The spring 616 may be a coil spring or any other suitable spring or driver. The spring 616 is shown to include a first anchor 680 and a second anchor 690. The first anchor 680 may be positioned at a first end of the spring 616, and the second anchor 690 may be positioned at a second end of the spring 616. According to an exemplary embodiment, the first anchor 680 and the second anchor 690 are configured to couple (e.g., engage, receive, etc.) one or more components of the clasp 504. For example, the first anchor 680 may be configured to couple (e.g., engage, etc.) the anchor 660 (e.g., the groove 664, etc.) of the housing bottom 650, and the second anchor 690 may be configured to couple (e.g., engage, etc.) the anchor 670 of the actuator housing 612. In this regard, the spring 616 may be configured to be positioned within the actuator housing 612 (which may be positioned within the housing bottom 650), with the first anchor 680 coupled with the anchor 660 (e.g., via the groove 664, etc.) of the housing bottom 650 and the second anchor 690 coupled with the anchor 670 of the actuator housing 612 (e.g., as shown in at least FIG. 13).

According to an exemplary embodiment, and as described herein, the spring 616 may be configured to bias between a first configuration (e.g., an expanded state) and a second configuration (e.g., a compressed, non-expanded, etc. state). For example, the spring 616 may be coupled with the anchor 660 of the housing bottom 650 and the anchor 670 of the actuator housing 612. In a first configuration (e.g., in an expanded state) the spring 616 may exert a force (e.g., rotational force, biasing force, etc.) on the actuator housing 612, for example to force the actuator housing 612 into a first configuration. In the first configuration, the actuator housing 612 (e.g., via the spring 616) may be wrapped in a cord (e.g., the cord 218 wrapped around the connector interface 674, etc.), such that the cord and a hook (e.g., coupled with the cord 218, etc.) may be drawn toward the housing 600 (e.g., the housing bottom 650, etc.). In response to a manipulation of the cord (e.g., via a user or operator, for example pulling on the cord, a clasp, a hook, etc.), the spring 616 may transition to a second configuration. In the second configuration, the cord may be drawn away from the housing 600 (e.g., the housing bottom 650, through the hole 662, etc.), and the spring 616 may impart a resistive force (e.g., via a rotation of the actuator housing 612) on the cord and the actuator housing 612, for example to limit or prevent movement of the cord away from the housing 600 (e.g., out of the housing bottom 650, through the hole 662, etc.). In an exemplary embodiment, when the manipulation is released, the spring 616 may again return to the first configuration, thereby drawing the cord back toward the housing 600 (e.g., into the housing bottom 650, through the hole 662, etc.).

As an illustrative implementation, the clasp 504 may be implemented as a component of a jewelry system (e.g., the jewelry system 100 of FIGS. 1-7). For example, the clasp 504 may be provided with the necklace 102 of FIGS. 1-7. In this regard, the clasp 504 may be provided with the cord 218 and a clasp hook (e.g., the clasp hook 202) or a clasp ring (e.g., the clasp ring 204) coupled with the cord 218, or any other suitable components described herein.

According to an exemplary embodiment, the clasp 504 may be assembled. In an exemplary embodiment, the connector interface 674 may receive the cord 218, for example by winding the cord 218 about the actuator housing 612 (e.g., in a spool-like configuration). In an exemplary implementation, the spring 616 may be positioned within the actuator housing 612, for example with the second anchor 690 (e.g., at a second end of the spring 616) coupled with the anchor 670 of the actuator housing 612 (e.g., as shown in at least FIG. 13). The actuator housing 612 may further be positioned within the housing bottom 650, for example with the opening 672 of the actuator housing 612 receiving the anchor 660 of the housing bottom 650 (e.g., thereby centering the actuator housing 612 within the housing bottom 650, etc.). With the actuator housing 612 positioned within the housing bottom 650, the first anchor 680 of the spring 616 may be coupled with the anchor 660 (e.g., via the groove 664, etc.) of the housing bottom 650 (e.g., as shown in at least FIG. 14). According to an exemplary embodiment, an end of the cord 218 may extend toward an exterior of the housing 600, for example through the hole 662 in the housing bottom 650. In some embodiments, the housing top 652 may be coupled with the housing bottom 650, for example enclosing the actuator 610 (e.g., the actuator housing 612, the spring 616, etc.) within the housing 600.

As an illustrative example implementation, in response to a manipulation or force, the clasp 504 may transition from a first configuration to a second configuration. For example, with the clasp 504 assembled, the spring 616 may exert a force (e.g., rotational force, biasing force, etc.) on the actuator housing 612, for example to force the actuator housing 612 into a first configuration (e.g., in a wrapped or wound configuration within the housing bottom 650). In response to a manipulation (e.g., of the cord 218, of the clasp hook 202, of the clasp ring 204, etc.), for example via a force exerted by a user or operator, the spring 616 may transition to a second configuration. For example, the cord 218 may be drawn away from the housing 600 (e.g., through the hole 662, etc.), thereby unwinding the cord 218 and causing the actuator housing 612 to rotate within the housing bottom 650. As the cord 218 is drawn away from the housing 600 (e.g., the actuator housing 612 rotates, etc.), the spring 616 may impart a resistive force (e.g., via the coupling with the anchor 660 of the housing bottom 650) on the cord 218 and the actuator housing 612, for example to limit rotation of the actuator housing 612 and movement of the cord 218 away from the housing 600 (e.g., through the hole 662 of the housing bottom 650). With the clasp 504 in the second configuration (e.g., expanded configuration, etc.), the necklace 102 can be fit onto the body of the user (e.g., over the user's head, around their neck, etc.). When manipulation of the cord 218 is released, the spring 616 may again return to the first configuration (e.g., causing counter-rotation of the actuator housing 612, etc.), thereby drawing the cord 218 back toward and into the housing 600 (e.g., through the hole 662 of the housing bottom 650), so as to securely fit the necklace on the body of the user.

Referring generally to FIGS. 15-18, a clasp 704 is shown, according to an exemplary embodiment. As shown in FIGS. 15-18, the clasp 704 includes a housing 800 (e.g., as shown in at least FIG. 18) and a controller, regulator, or actuator, shown as actuator 810 (e.g., as shown in at least FIGS. 17-18), which is shown to include a case or casing, shown as actuator housing 812, and a driver, shown as spring 816. It should be understood that in some embodiments, one or more components of the clasp 704 may be or include one or more components similar to one or more components of a clasp described herein (e.g., the clasp 504 of FIGS. 8-14). As described herein, the clasp 704 may be configured to transition between a first configuration (e.g., retracted, collapsed, coiled, etc.) and a second configuration (e.g., non-retracted, expanded, un-coiled, etc.), for example to allow a user to fit a piece of jewelry onto their body (e.g., over their head, around their neck, over their hand, on their wrist, etc.).

As also described herein, the clasp 704 may be implemented with any or all of the components of the jewelry system 100. For example, the clasp 704 (e.g., the housing 800) may include a first interlocking component (e.g., a clasp hook, the clasp hook 202, etc.) and a second interlocking component (e.g., a clasp ring, the clasp ring 204, etc.), for example as shown in at least FIG. 18. In some embodiments, the first interlocking component (e.g., the clasp hook 202, etc.) may extend from a first portion of the clasp 704 (e.g., the housing 800) and the second interlocking component (e.g., the clasp ring 204) may extend from a second portion of the clasp 704 (e.g., the housing 800), for example as shown in at least FIG. 18 and as described elsewhere herein. In some embodiments, one of the first interlocking component (e.g., the clasp hook 202) and the second interlocking component (e.g., the clasp ring 204) is movable (e.g., relative to the clasp 704, relative to the housing 800), for example as the clasp 704 transitions between the first configuration and the second configuration. In some embodiments, one of the first interlocking component and the second interlocking component is fixed relative to the clasp 704 (e.g., the housing 800).

According to an exemplary embodiment, the housing 800 includes a bottom or lower portion, and a top or upper portion, which may be configured to selectively couple, as described herein. The housing may by any suitable shape, size, or configuration, which may include one or more modular layers, surfaces, materials, or interfaces, as described herein. Further, the housing 800 may include an anchor, which may be a projection, protrusion, post, or pole, for example to couple (e.g., receive, engage, etc.) a component of the clasp 704 (e.g., a driver, the spring 816, etc.). For example, the anchor of the housing 800 may be configured to couple (e.g., receive, engage, etc.) a driver of the clasp 704 to anchor the driver (e.g., the spring 816) relative to the housing 800, for example to facilitate transitioning the driver (e.g., the spring 816, etc.) between one or more configurations, as described herein. In some embodiments, the housing 800 includes an aperture or opening, for example to facilitate movement of a cord relative to the housing 800 (e.g., out of, into, etc. the housing 800), as described herein. In some embodiments, it is contemplated that the housing 800 includes additional, fewer, or different components, which may be otherwise arranged or configured, as described herein.

Figure 15:
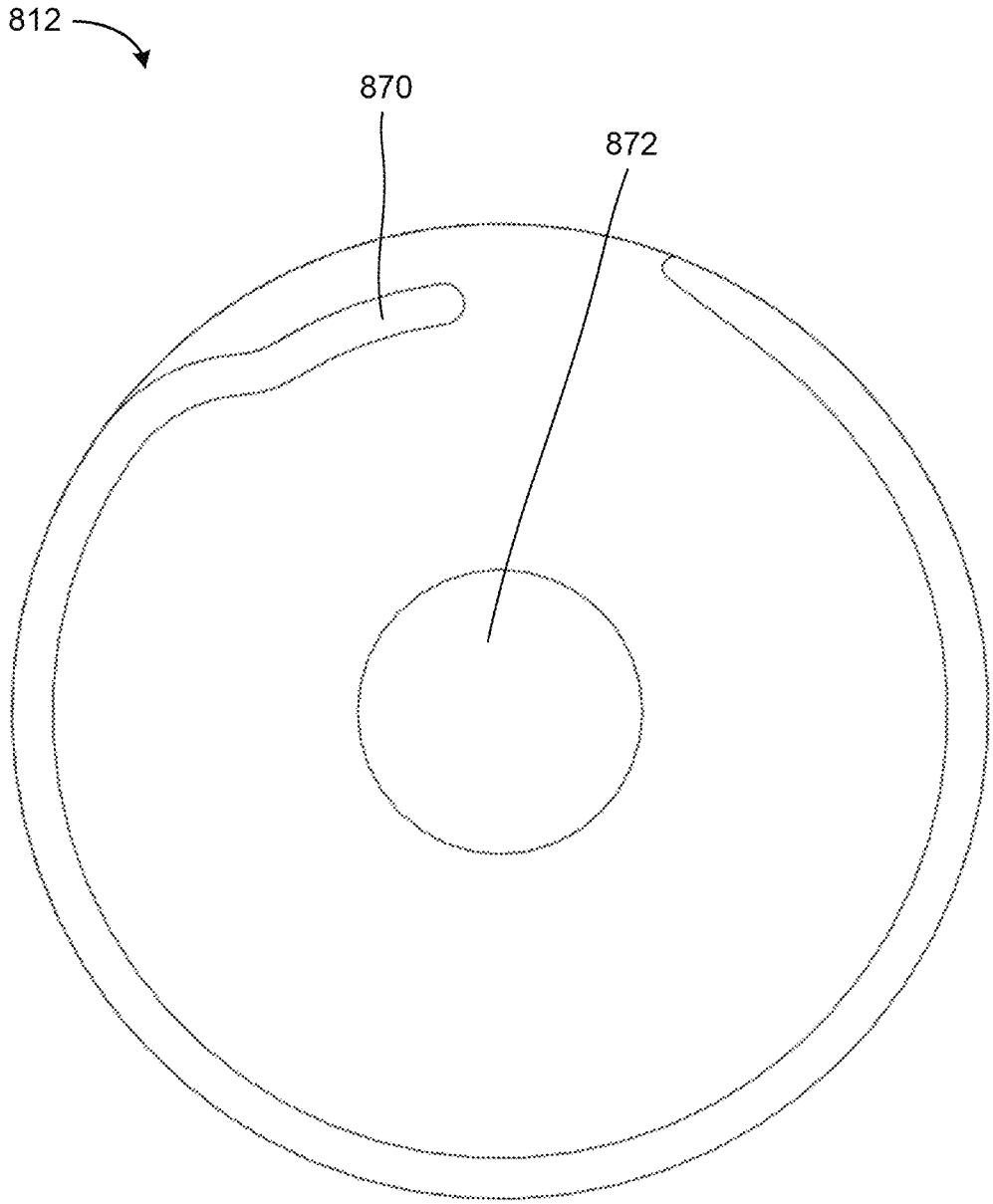
FIG. 15 is a top view of an actuator housing of a clasp of the jewelry system of FIG. 1, according to an exemplary embodiment.
Figure 16:
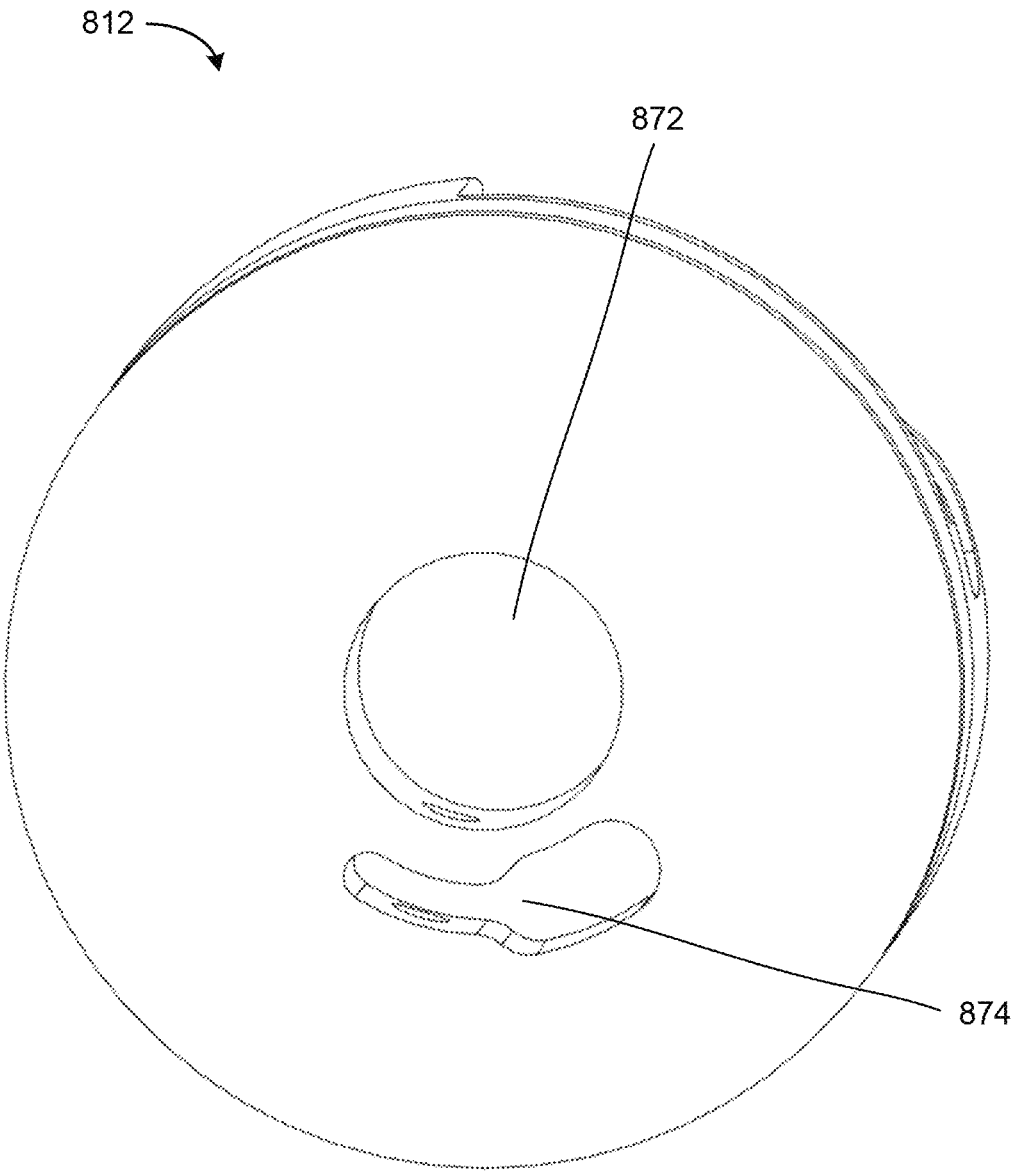
FIG. 16 is a bottom view of the actuator housing of FIG. 15, according to an exemplary embodiment.
Figure 17:
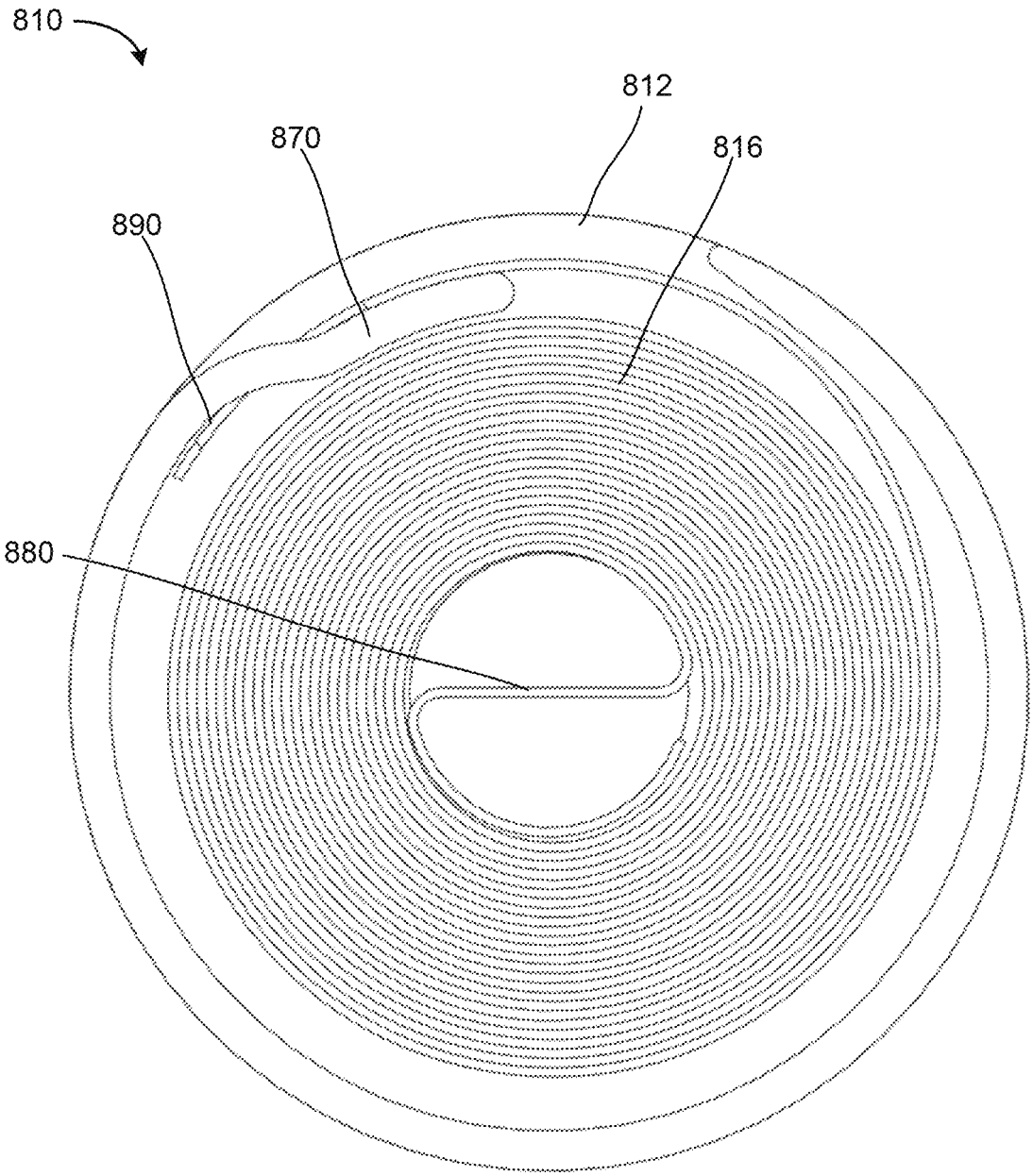
FIG. 17 is top view of an actuator including the actuator housing of FIG. 15, according to an exemplary embodiment.
Figure 18:
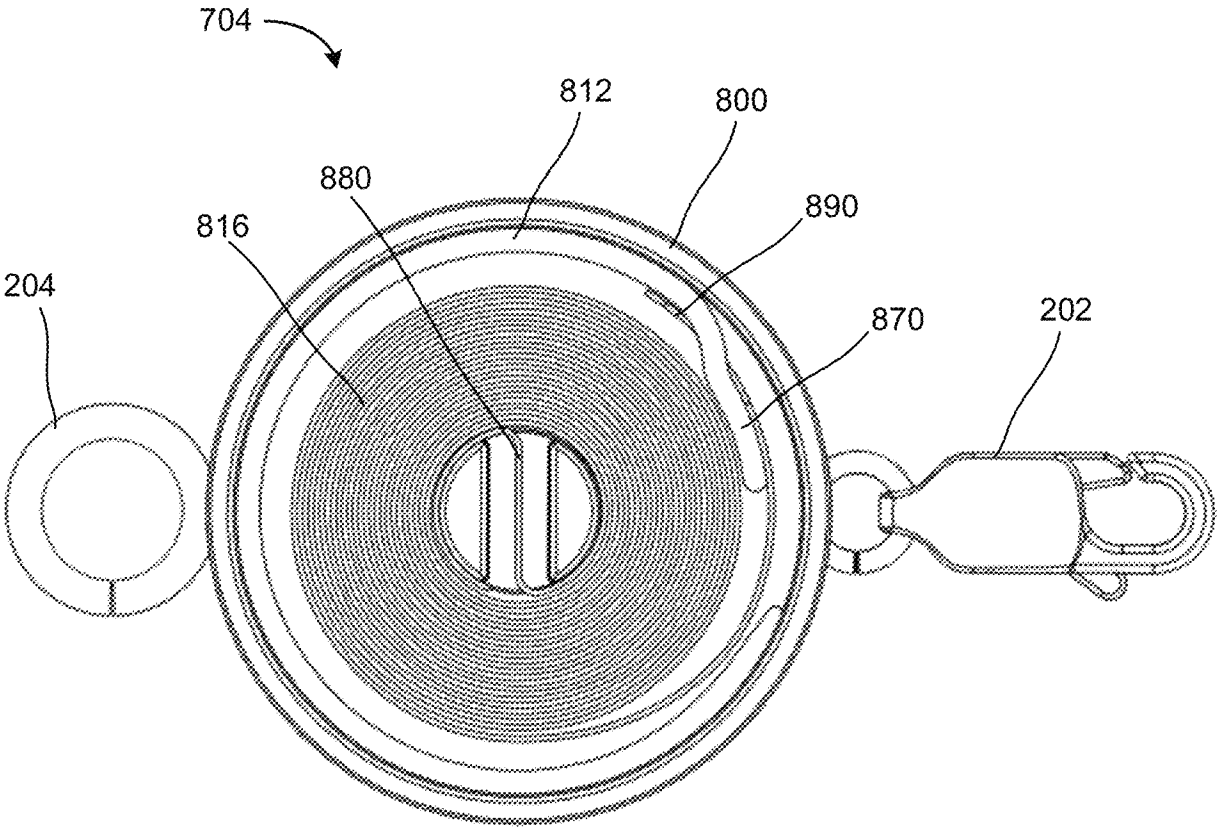
FIG. 18 is a top view of a clasp including the actuator housing of FIG. 15, according to an exemplary embodiment.
Figure 19:
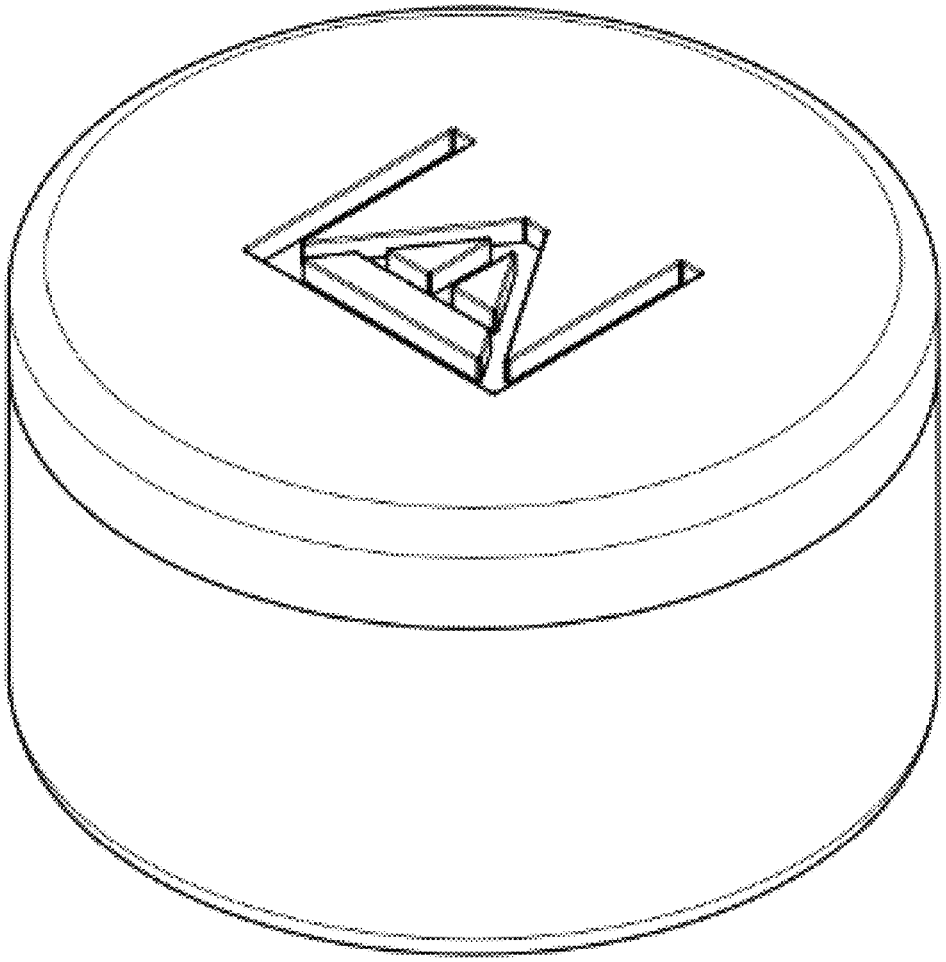
FIG. 19 is a perspective view of a clasp of the jewelry system of FIG. 1, according to an exemplary embodiment.
Figure 20:
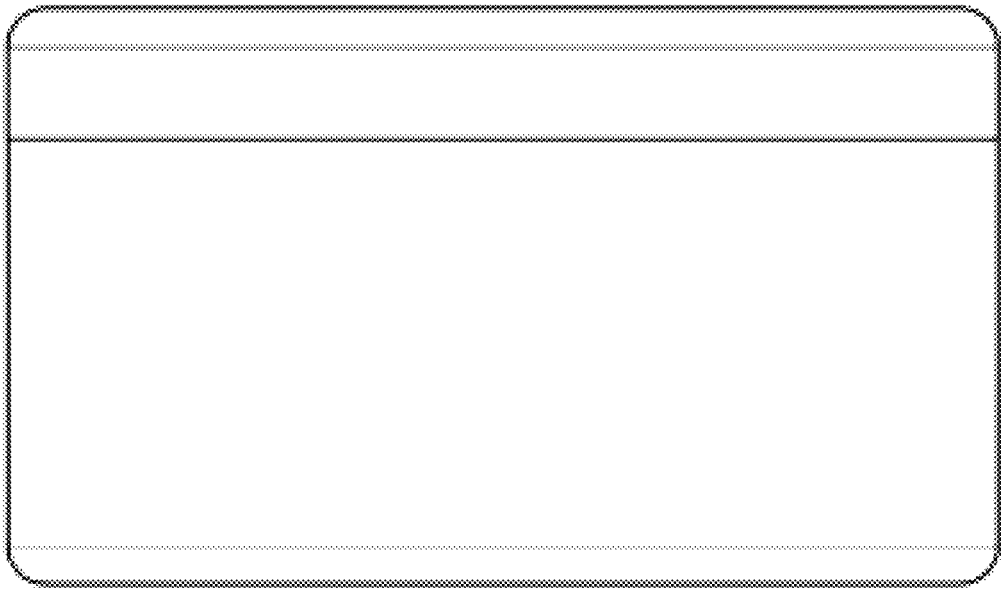
FIG. 20 is a front view of the clasp of FIG. 19, according to an exemplary embodiment.
Figure 21:
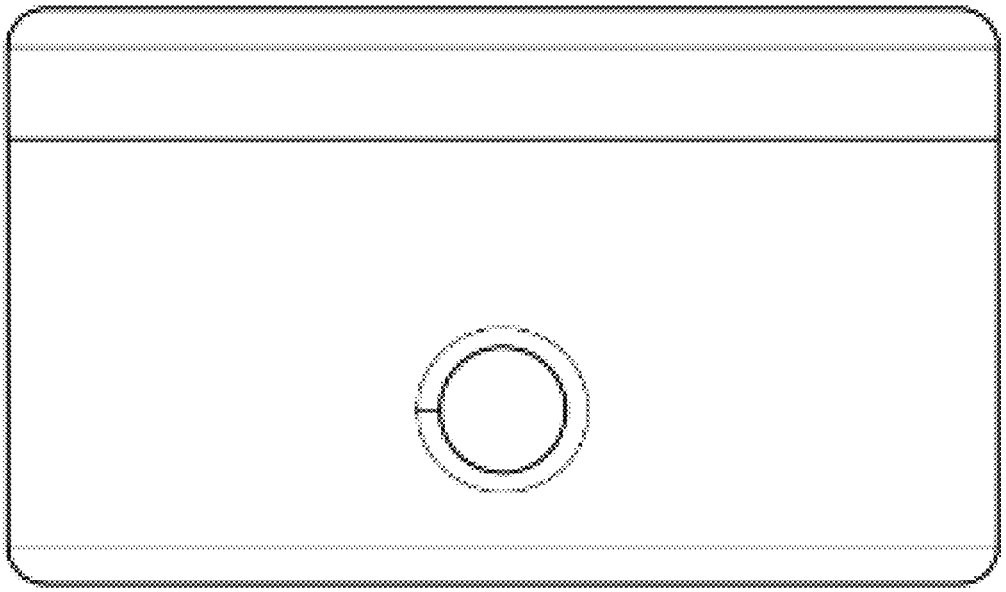
FIG. 21 is a rear view of the clasp of FIG. 19, according to an exemplary embodiment.
Figure 22:
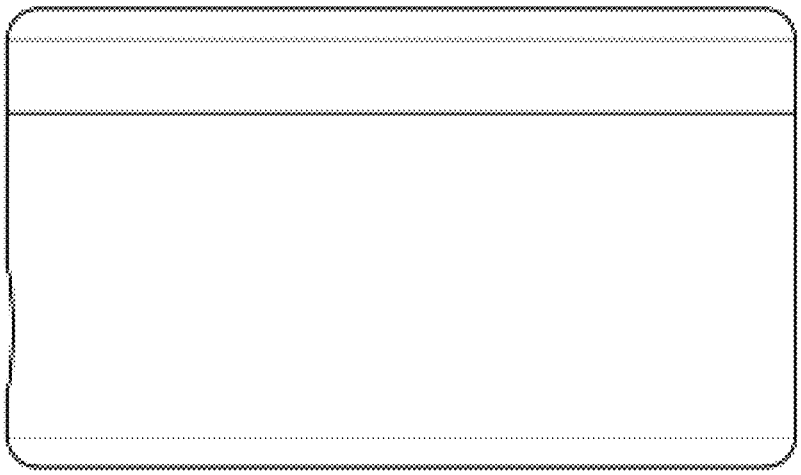
FIG. 22 is a right side view of the clasp of FIG. 19, according to an exemplary embodiment.
Figure 23:
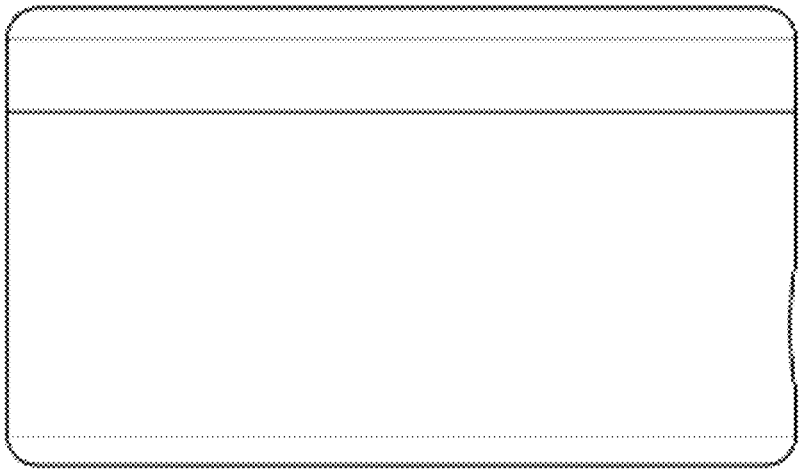
FIG. 23 is a left side view of the clasp of FIG. 19, according to an exemplary embodiment.
Figure 24:
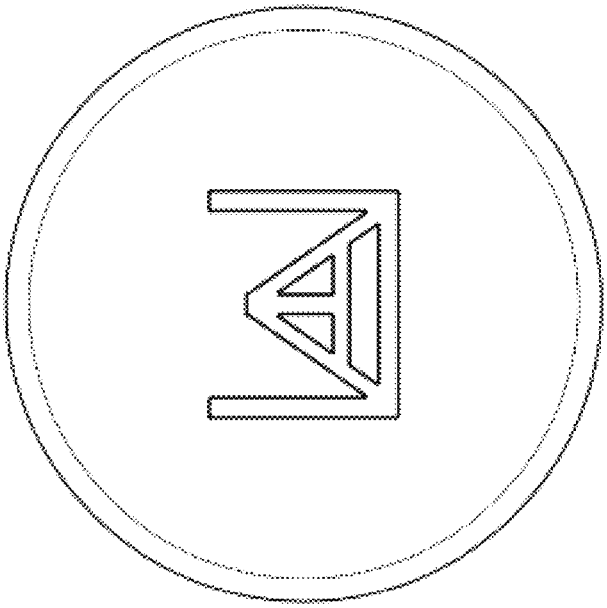
FIG. 24 is a top view of the clasp of FIG. 19, according to an exemplary embodiment.
Figure 25:
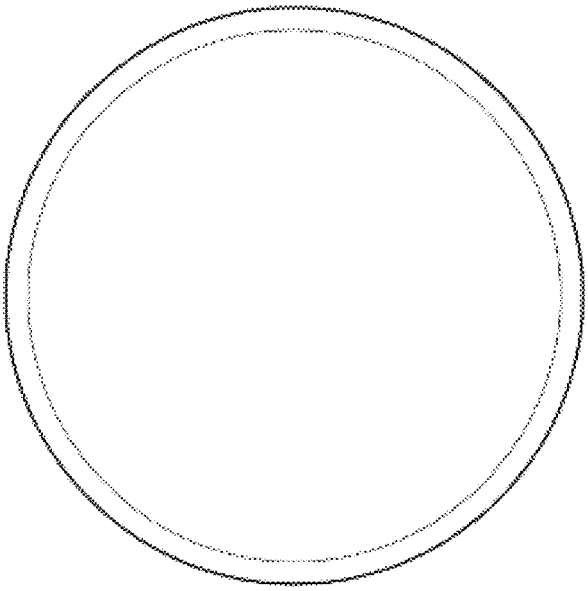
FIG. 25 is a bottom view of the clasp of FIG. 19, according to an exemplary embodiment.

As show in FIGS. 15-17, and as described herein, the actuator 810 is shown to include a case or casing, shown as the actuator housing 812, and a driver, shown as the spring 816. According to an exemplary embodiment, the actuator 810 is configured to be positioned within the housing 800 (e.g., as shown in at least FIG. 18). Further, and as described herein, the actuator 810 may be configured to transition (e.g., bias, move, rotate, etc.) between one or more configurations, for example to facilitate transitioning the clasp 704 between a first configuration (e.g., a retracted configuration, etc.) and a second configuration (e.g., a non-retracted configuration).

As shown in at least FIGS. 15-16, the actuator housing 812 is a circular or round shape. The actuator housing 812 is shown to include an anchor 870, a hole or aperture, shown as opening 872, and a connector interface 874 (e.g., as shown in at least FIG. 16). In an exemplary embodiment, the anchor 870 is a flange, rib, or collar. The anchor 870 may extend from an exterior portion of the actuator housing 812 (e.g., an exterior portion at a circumferential exterior boundary of the actuator housing 812, etc.) toward a central or middle portion of the actuator housing 812 (e.g., toward a center, toward a central axis, toward the opening 872, etc.). In some embodiments, the anchor 870 is a projection, protrusion, post, or pole. According to an exemplary embodiment, the anchor 870 may be configured to couple (e.g., receive, engage, etc.) a component of the clasp 704 (e.g., a driver, the spring 816, etc.). For example, the anchor 870 may be configured to couple (e.g., receive, engage, etc.) a driver of the clasp 704 (e.g., the spring 816), for example to anchor the driver (e.g., the spring 816) relative to the actuator housing 812 (e.g., as shown in at least FIG. 17). According to an exemplary embodiment, the anchor 870 is also configured to couple a driver of the clasp 704 (e.g., the spring 816) to facilitate transitioning the driver (e.g., the spring 816) between one or more configurations (e.g., a coiled configuration, an un-coiled configuration, etc.).

In this regard, and as explained herein, the driver (e.g., the spring 816) may be coupled with an anchor of the housing 800 (e.g., at a first end, etc.) and the anchor 870 of the actuator housing 812 (e.g., at a second end, etc.), for example facilitate transitioning (e.g., biasing, etc.) the driver (e.g., the spring 816) between one or more configurations (e.g., a coiled configuration, an un-coiled configuration, etc.), as described herein. The anchor 870 may be positioned at an exterior portion of the actuator housing 812 and extend toward an interior or central portion of the actuator housing 812 (e.g., toward a central axis, toward the opening 872, etc.), though it is contemplated that in some embodiments the anchor 870 is otherwise shaped, sized, configured, or positioned.

As shown in at least FIGS. 15-16, the actuator housing 812 includes the opening 872. The opening 872 may extend through a bottom or bottom surface of the actuator housing 812 or may be positioned at a central portion of the actuator housing 812 (e.g., a center of a bottom of the actuator housing 812, a central axis of rotation of the actuator housing 812, etc.). According to an exemplary embodiment, the opening 872 is configured to receive a component of the clasp 704. For example, the opening 872 may be configured to receive an anchor of the housing 800, as described herein. In this regard, the actuator housing 812 may be positioned within the housing 800 (e.g., a housing bottom or bottom of the housing 800, etc.), such that an anchor of the housing 800 extends through the opening 872, for example to position the actuator housing 812 relative to the housing 800 (e.g., to center the actuator housing 812 relative to the housing 800, position the actuator housing 812 about a central axis of the housing 800, etc.).

As shown in FIG. 16, the actuator housing 812 includes the connector interface 874. In some embodiments, the connector interface 874 includes one or more projections, protrusions, posts, or poles. In some embodiments, the connector interface 874 extends from a bottom surface or bottom portion of the actuator housing 812. The connector interface 874 may be positioned at a bottom portion toward a central region of the actuator housing 812 (e.g., a central region offset from a center or central axis of the actuator housing 812, extending around a center or central axis of the actuator housing 812, etc.). According to an exemplary embodiment, the connector interface 874 is configured to engage (e.g., receive, couple, de-couple, etc.) a connector or cord (e.g., the cord 218). For example, the connector interface 874 may be configured to receive a cord (e.g., the cord 218), such that the cord is wound around the connector interface 874 (e.g., in a spool-like configuration).

In some embodiments, the connector interface 874 engages the connector or cord in another suitable configuration (e.g., through an opening, at an interior surface of the actuator housing 812, etc.), for example such that the cord is otherwise wound, spun, twirled, or otherwise arranged. It should be understood that while the connector interface 874 is described as one or more projections, protrusions, posts, or poles positioned at a surface or bottom portion of the actuator housing 812, it is contemplated that in some embodiments the connector interface 874 is otherwise shaped, sized, configured, or positioned (e.g., includes grooves or ridges, includes a collar or flange, extends around an upper portion, extends around a middle portion, etc.).

As shown in FIG. 17, the actuator 810 includes a driver, shown as the spring 816. The spring 816 may be a coil spring or any other suitable spring or driver. The spring 816 is shown to include a first anchor 880 and a second anchor 890. The first anchor 880 may be positioned at a first end of the spring 816, and the second anchor 890 may be positioned at a second end of the spring 816 (e.g., opposite the first end of the spring 816, etc.). According to an exemplary embodiment, the first anchor 880 and the second anchor 890 are configured to couple (e.g., engage, receive, etc.) one or more components of the clasp 704.

For example, the first anchor 880 may be configured to couple (e.g., engage, etc.) an anchor of the housing 800 (e.g., a post, protrusion, etc.), as described herein. The second anchor 890 may be configured to couple (e.g., engage, etc.) the anchor 870 of the actuator housing 812. For example, the second anchor 890 may extend through an opening (e.g., an aperture, hole, etc.) in the anchor 870 (e.g., the flange, etc.) of the actuator housing 812, for example to engage (e.g., couple, etc.) the second anchor 890 within a divot in the actuator housing 812 (e.g., on an interior or inside surface of a wall of the actuator housing 812, etc.). In this regard, the spring 816 may be configured to be positioned within the actuator housing 812 (which may be positioned within the housing 800), with the first anchor 880 coupled with an anchor of the housing 800 and the second anchor 890 coupled with the anchor 870 of the actuator housing 812 (e.g., as shown in at least FIG. 17).

According to an exemplary embodiment, and as described elsewhere herein, the spring 816 may be configured to bias between a first configuration (e.g., an expanded state) and a second configuration (e.g., a compressed, non-expanded, etc. state). For example, the spring 816 may be coupled with an anchor of the housing 800 and the anchor 870 of the actuator housing 812 (e.g., as shown in at least FIG. 17). In a first configuration (e.g., in an expanded state) the spring 816 may exert a force (e.g., rotational force, biasing force, etc.) on the actuator housing 812, for example to force the actuator housing 812 into a first configuration. In the first configuration, the actuator housing 812 (e.g., via the spring 816) may be wrapped in a cord (e.g., the cord 218 wrapped around the connector interface 874, etc.), such that the cord and a hook (e.g., the clasp hook 202 coupled with the cord 218, etc.) may be drawn toward the housing 800. In response to a manipulation of the cord (e.g., via a user or operator, for example pulling on the cord 218, the clasp hook 202, a clasp or a hook coupled with the cord 218, etc.), the spring 816 may transition to a second configuration. In the second configuration, the cord may be drawn away from the housing 800 (e.g., through a hole in the housing 800, etc.), and the spring 816 may impart a resistive force (e.g., via a rotation of the actuator housing 812) on the cord and the actuator housing 812, for example to limit or prevent movement of the cord away from the housing 800 (e.g., out of the housing 800, through the hole in the housing 800, etc.). In an exemplary embodiment, when the manipulation is released, the spring 816 may again return to the first configuration, thereby drawing the cord back toward the housing 800 (e.g., into the housing 800, through the hole in the housing 800, for example via rotation of the actuator housing 812 within the housing 800 by the spring 816, etc.).

As an illustrative example implementation, in response to a manipulation or force, the clasp 704 may transition from a first configuration to a second configuration. For example, with the clasp 704 assembled, the spring 816 may exert a force (e.g., rotational force, biasing force, etc.) on the actuator housing 812, for example to force the actuator housing 812 into a first configuration (e.g., in a wrapped or wound configuration within the housing 800). In response to a manipulation (e.g., of the cord 218, of the clasp hook 202, of the clasp ring 204, etc.), for example via a force exerted by a user or operator, the spring 816 may transition to a second configuration. For example, the cord 218 may be drawn away from the housing 800 (e.g., through a hole in the housing 800, etc.), thereby unwinding the cord 218 and causing the actuator housing 812 to rotate within the housing 800. As the cord 218 is drawn away from the housing 800 (e.g., the actuator housing 812 rotates, etc.), the spring 816 may impart a resistive force (e.g., via the coupling with an anchor of the housing 800) on the cord 218 and the actuator housing 812, for example to limit rotation of the actuator housing 812 and movement of the cord 218 away from the housing 800 (e.g., through the hole of the housing 800). With the clasp 704 in the second configuration (e.g., expanded configuration, etc.), a necklace can be fit onto the body of the user (e.g., over the user's head, around their neck, etc.). When manipulation of the cord 218 is released, the spring 816 may again return to the first configuration (e.g., causing counter-rotation of the actuator housing 812, etc.), thereby drawing the cord 218 back toward and into the housing 800 (e.g., through the hole of the housing 800), so as to securely fit the necklace on the body of the user.

Referring generally to FIGS. 19-25, illustrations of a clasp are shown, according to an exemplary embodiment. In some embodiments, the clasp of FIGS. 19-25 is the clasp 104 of FIGS. 1-7, the clasp 504 of FIGS. 8-14, or the clasp 704 of FIGS. 15-18. In an exemplary embodiment, the clasp of FIGS. 19-25 may be implemented with a jewelry system, as described herein.

It should be understood that any or all of the components of the jewelry system 100 described herein may be provided, packaged, or manufactured separately or as a kit. Further, it should be understood that any or all of the components of the jewelry system 100 described herein may be provided (e.g., manufactured, designed, etc.) using any suitable technique, design, or process. For example, any or all of the components of the jewelry system 100 may be manufactured using one or more three-dimensional (3D) printing technologies, laser cutting techniques, engraving techniques, injection molding techniques (e.g., metal injection molding, plastic injection molding, etc.), precision casting techniques, computer numerical control (CNC) machining techniques, electroforming techniques, advanced plating techniques (e.g., physical vapor deposition, etc.), micro welding techniques, flexible manufacturing systems (FMS) techniques, automated assembly line techniques, or any other suitable manufacturing process, design, technique, or a combination thereof. Advantageously, any or all of the components of the jewelry system 100 may be manufactured using any of the aforementioned techniques (or a combination thereof) to facilitate providing the jewelry system 100 with components that exhibit high-strength or light weight characteristics, fine detail, precise dimensions or proportions, or that conserve materials in the manufacturing processes.

It should be understood that no claim element herein is to be construed under the provisions of 35 U.S.C. § 112(f), unless the element is expressly recited using the phrase "means for."

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately,"

"about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any element on its own or any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes, and omissions may be made in the design, operating conditions, and arrangement of the embodiments without departing from the scope of the present disclosure as expressed in the appended claims.

What is claimed is:

1. A jewelry system comprising:

a necklace having a first end and a second end; and a clasp comprising:

a housing having a housing top and a housing bottom, the housing bottom comprising a hole disposed in a side of the housing bottom and an anchor post comprising a groove disposed perpendicular to the hole, the anchor post centered within the housing bottom;

an actuator comprising:

an actuator housing comprising a housing anchor, an opening, and a connector interface, wherein the housing anchor includes a flange and an aperture extending through the flange; and a spring comprising a first spring anchor and a second spring anchor, wherein the spring is received in the actuator housing by extending the second spring anchor through the aperture to engage the flange thereby coupling the second spring anchor with the housing anchor, and wherein the actuator housing is received in the housing bottom such that the anchor post is inserted into the opening of the actuator housing and the groove of the anchor post receives the first spring anchor of the spring, such that the spring is configured to rotate the actuator housing respective of the housing bottom when the spring biases between an expanded configuration and a compressed configuration; and a cord having a first end coupled with the connector interface of the actuator housing and a second end configured to be pulled away from the clasp;

wherein the housing top is configured to couple with the housing bottom to retain the actuator housing therein, and wherein when a force is applied to the necklace, the cord is configured to be pulled away from the clasp to cause the actuator housing to rotate relative to the housing bottom, and wherein when the force is applied to the necklace the clasp is configured to transition from a retracted configuration to a non-retracted configuration, wherein the necklace and the clasp have a first circumference when in the retracted configuration, and wherein the necklace and the clasp have a second circumference when in the non-retracted configuration that is greater than the first circumference.

2. The jewelry system of claim 1, wherein the flange extends from an exterior portion of the actuator housing toward a central portion of the actuator housing.

3. The jewelry system of claim 1, wherein the flange extends from an exterior circumferential boundary of the actuator housing toward the opening.

4. The jewelry system of claim 1, wherein the connector interface extends about an exterior of the actuator housing.

5. The jewelry system of claim 4, wherein the connector interface is configured to engage the cord to wind the cord about the actuator housing when the clasp is in the retracted configuration.

6. The jewelry system of claim 1, wherein the hole of the housing bottom is disposed at a bottom portion of the housing bottom.

7. The jewelry system of claim 1, wherein the first spring anchor includes a flat interface to be received by a flat interface of the groove of the anchor post.

8. The jewelry system of claim 1, wherein in the expanded configuration the spring is configured to apply a biasing force to the actuator housing to hold the actuator housing stationary relative to the housing bottom.

9. The jewelry system of claim 8, wherein when the force is applied to the necklace the spring is configured to bias to the compressed configuration, and wherein in the compressed configuration the spring is configured to limit a rotational movement of the actuator housing relative to the housing bottom.

10. A clasp comprising:

a housing having a housing top and a housing bottom, the housing bottom comprising a hole disposed in a side of the housing bottom and an anchor post comprising a groove disposed perpendicular to the hole, the anchor post centered within the housing bottom;

an actuator comprising:

an actuator housing comprising a housing anchor, an opening, and a connector interface, wherein the housing anchor includes a flange and an aperture extending through the flange; and a spring comprising a first spring anchor and a second spring anchor, wherein the spring is received in the actuator housing by extending the second spring anchor through the aperture to engage the flange thereby coupling the second spring anchor with the housing anchor, and wherein the actuator housing is received in the housing bottom such that the anchor post is inserted into the opening of the actuator housing and the groove of the anchor post receives the first spring anchor of the spring, such that the spring is configured to rotate the actuator housing respective of the housing bottom when the spring biases between an expanded configuration and a compressed configuration; and a cord having a first end coupled with the connector interface of the actuator housing and a second end configured to be pulled away from the clasp;

wherein the housing top is configured to couple with the housing bottom to retain the actuator housing therein, and wherein when a force is applied to the cord, the cord is configured to be pulled away from the clasp to cause the actuator housing to rotate relative to the housing bottom, and wherein when the force is applied to the cord the clasp is configured to transition from a retracted configuration to a non-retracted configuration, wherein the cord and the clasp have a first length when in the retracted configuration, and wherein the cord and the clasp have a second length when in the non-retracted configuration that is greater than the first length.

11. The clasp of claim 10, wherein the flange extends from an exterior portion of the actuator housing toward a central portion of the actuator housing.

12. The clasp of claim 10, wherein the flange extends from an exterior circumferential boundary of the actuator housing toward the opening.

13. The clasp of claim 10, wherein the connector interface extends about an exterior of the actuator housing.

14. The clasp of claim 13, wherein the connector interface is configured to engage the cord to wind the cord about the actuator housing when the clasp is in the retracted configuration.

15. The clasp of claim 10, wherein the hole of the housing bottom is disposed at a bottom portion of the housing bottom.

16. The clasp of claim 10, wherein the first spring anchor includes a flat interface to be received by a flat interface of the groove of the anchor post.

17. The clasp of claim 10, wherein in the expanded configuration the spring is configured to apply a biasing force to the actuator housing to hold the actuator housing stationary relative to the housing bottom.

18. The clasp of claim 17, wherein when the force is applied to the cord the spring is configured to bias to the compressed configuration, and wherein in the compressed configuration the spring is configured to limit a rotational movement of the actuator housing relative to the housing bottom.

19. A jewelry kit comprising:

a necklace having a first end and a second end; and a clasp configured to couple with the first end and the second end, the clasp comprising a housing, an actuator including an actuator housing having a flange and an aperture extending through the flange, and a cord, wherein the actuator further comprises a spring received by the actuator housing by extending the spring through the aperture to engage the flange thereby coupling the spring with the anchor housing, and wherein the spring is configured to rotate the actuator housing respective of the housing when the spring biases between an expanded configuration when the cord is in a retracted configuration and the necklace has a first circumference and between a compressed configuration when the cord is in a non-retracted configuration and the necklace has a second circumference that is greater than the first circumference.

20. The jewelry kit of claim 19, further comprising a pendant configured to couple with the necklace.

* * * * *